US009134656B2

(12) United States Patent
Mizutani et al.

(10) Patent No.: US 9,134,656 B2
(45) Date of Patent: Sep. 15, 2015

(54) IMAGE FORMING APPARATUS

(71) Applicants: Takehide Mizutani, Kanagawa (JP); Hirokazu Ishii, Tokyo (JP); Tsutomu Kato, Kanagawa (JP); Yasufumi Takahashi, Kanagawa (JP); Shinya Tanaka, Kanagawa (JP); Osamu Ichihashi, Kanagawa (JP); Yuji Kato, Kanagawa (JP)

(72) Inventors: Takehide Mizutani, Kanagawa (JP); Hirokazu Ishii, Tokyo (JP); Tsutomu Kato, Kanagawa (JP); Yasufumi Takahashi, Kanagawa (JP); Shinya Tanaka, Kanagawa (JP); Osamu Ichihashi, Kanagawa (JP); Yuji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/256,178

(22) Filed: Apr. 18, 2014

(65) Prior Publication Data

US 2014/0328603 A1 Nov. 6, 2014

(30) Foreign Application Priority Data

May 1, 2013 (JP) ..... 2013-096273
May 22, 2013 (JP) ..... 2013-107857

(51) Int. Cl.
*G03G 21/00* (2006.01)
*G03G 15/00* (2006.01)
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/00; G03G 15/1675; G03G 15/1605; G03G 15/16; G03G 21/00
USPC ..... 399/34, 71, 123, 314
See application file for complete search history.

(56) References Cited

U.S. PATENT DOCUMENTS 5,515,146 A 5/1996 Harasawa et al.
5,587,780 A * 12/1996 Sugino et al. ..... 399/315
5,631,725 A 5/1997 Harasawa et al.
5,812,919 A 9/1998 Takano et al.
5,822,667 A 10/1998 Hayama et al.

(Continued)

FOREIGN PATENT DOCUMENTS

JP 05053401 A * 3/1993 ..... G03G 15/00
JP 05181372 A * 7/1993 ..... G03G 21/00

(Continued)

OTHER PUBLICATIONS

U.S. Appl. No. 14/173,122, filed Feb. 5, 2014.

(Continued)

*Primary Examiner* — Nguyen Ha
(74) *Attorney, Agent, or Firm* — Oblon, McClelland, Maier & Neustadt, L.L.P.

(57) ABSTRACT

An image forming apparatus includes an image carrier, a transfer member, a power supply, and a control device that controls the power supply to output a DC-AC superimposed bias or a DC bias to transfer a toner image on the image carrier onto a recording medium. The control device controls the power supply to alternately output a first bias being a DC component the same in polarity as the DC bias and a second bias being a DC component opposite in polarity to the DC bias to clean the transfer member when image formation is not taking place. The first bias is output with two target output values including a first value and a second value lower than the first value. The second bias is output with one target output value. An output time of the second bias is longer than an output time of the first bias.

14 Claims, 14 Drawing Sheets

(56) References Cited

U.S. PATENT DOCUMENTS

| | | | | |
|---|---|---|---|---|
| 5,930,573 | A | 7/1999 | Miyamoto et al. | |
| 6,188,862 | B1 | 2/2001 | Ishii | |
| 6,282,386 | B1 | 8/2001 | Ishii | |
| 2003/0035658 | A1 | 2/2003 | Ishii | |
| 2003/0219296 | A1 | 11/2003 | Kabata et al. | |
| 2005/0180767 | A1 | 8/2005 | Ishii et al. | |
| 2005/0281570 | A1* | 12/2005 | Takeuchi et al. | 399/49 |
| 2007/0003333 | A1 | 1/2007 | Ishii | |
| 2007/0127941 | A1 | 6/2007 | Ishii et al. | |
| 2009/0196638 | A1 | 8/2009 | Sukesako et al. | |
| 2010/0008687 | A1 | 1/2010 | Ishii | |
| 2010/0040386 | A1 | 2/2010 | Mizutani et al. | |
| 2010/0142985 | A1 | 6/2010 | Minbe et al. | |
| 2010/0221029 | A1 | 9/2010 | Minbu et al. | |
| 2010/0232824 | A1* | 9/2010 | Shibuya et al. | 399/71 |
| 2010/0260511 | A1* | 10/2010 | Kojima et al. | 399/46 |
| 2011/0158690 | A1 | 6/2011 | Mimbu et al. | |
| 2011/0229185 | A1* | 9/2011 | Shibuya et al. | 399/99 |
| 2012/0121293 | A1 | 5/2012 | Mimbu et al. | |
| 2012/0170951 | A1 | 7/2012 | Ishii | |
| 2012/0230715 | A1 | 9/2012 | Ogino et al. | |
| 2012/0237234 | A1 | 9/2012 | Sugimoto et al. | |
| 2012/0237260 | A1 | 9/2012 | Sengoku et al. | |
| 2012/0308250 | A1 | 12/2012 | Shimizu et al. | |
| 2012/0315055 | A1* | 12/2012 | Zaima | 399/49 |
| 2012/0328314 | A1 | 12/2012 | Sugimoto et al. | |
| 2012/0328321 | A1 | 12/2012 | Takeuchi et al. | |
| 2013/0051832 | A1* | 2/2013 | Aiba | 399/71 |
| 2013/0064559 | A1 | 3/2013 | Nakamura et al. | |
| 2013/0089363 | A1 | 4/2013 | Mimbu et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0182269 | A1 | 7/2013 | Tanaka | |
| 2013/0189002 | A1 | 7/2013 | Ichihashi et al. | |
| 2013/0195483 | A1* | 8/2013 | Shimizu et al. | 399/45 |
| 2013/0216281 | A1 | 8/2013 | Suzuki et al. | |
| 2013/0223901 | A1 | 8/2013 | Minbe et al. | |
| 2013/0236201 | A1 | 9/2013 | Mizutani et al. | |
| 2013/0243482 | A1 | 9/2013 | Kato et al. | |
| 2013/0308968 | A1 | 11/2013 | Tanaka et al. | |
| 2014/0010562 | A1 | 1/2014 | Tanaka et al. | |
| 2014/0016956 | A1* | 1/2014 | Terasaki | 399/66 |
| 2014/0029988 | A1 | 1/2014 | Shimizu et al. | |
| 2014/0072340 | A1 | 3/2014 | Kato et al. | |
| 2014/0079418 | A1 | 3/2014 | Tanaka et al. | |
| 2014/0086603 | A1* | 3/2014 | Adachi | 399/44 |
| 2014/0356010 | A1* | 12/2014 | Furukawa | 399/71 |

FOREIGN PATENT DOCUMENTS

| | | | | | |
|---|---|---|---|---|---|
| JP | 9-146381 | | | 6/1997 | |
| JP | 09146381 | A | * | 6/1997 | G03G 15/16 |
| JP | 11-143145 | | | 5/1999 | |
| JP | 2002214938 | A | * | 7/2002 | G03G 15/16 |
| JP | 2003076164 | A | * | 3/2003 | G03G 15/00 |
| JP | 2006-267486 | | | 10/2006 | |
| JP | 2006267486 | A | * | 10/2006 | G03G 15/16 |
| JP | 2010-276766 | | | 12/2010 | |
| JP | 2011-158785 | | | 8/2011 | |
| JP | 2012063497 | A | * | 3/2012 | G03G 21/00 |
| JP | 2013-011835 | | | 1/2013 | |

OTHER PUBLICATIONS

U.S. Appl. No. 14/209,330, filed Mar. 13, 2014.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-096273, filed on May 1, 2013, in the Japan Patent Office, and Japanese Patent Application No. 2013-107857, filed on May 22, 2013, in the Japan Patent Office, the entire disclosures of which are hereby incorporated by reference herein.

BACKGROUND

1. Technical Field

The present invention relates to an image forming apparatus that transfers a toner image on an image carrier onto a recording medium.

2. Related Art

In a typical image forming apparatus that transfers a toner image on a surface of an image carrier onto a recording medium clamped in a transfer nip, the toner image is first formed on a surface of a drum-shaped photoconductor serving as an image carrier in accordance with a well-known electrophotographic process. The photoconductor is contacted against an endless intermediate transfer belt serving as an image carrier and an intermediate transfer member, to thereby form a primary transfer nip. In the primary transfer nip, the toner image on the photoconductor is primary-transferred onto the intermediate transfer belt. The intermediate transfer belt is then contacted against a secondary transfer roller serving as a transfer member (i.e., a secondary transfer member), to thereby form a secondary transfer nip. The intermediate transfer belt is clamped between the secondary transfer roller and a secondary transfer facing roller disposed inside a loop of the intermediate transfer belt. The secondary transfer facing roller inside the loop is electrically grounded and the secondary transfer roller outside the loop is supplied with a secondary transfer bias (voltage) from a power supply, thereby forming a secondary transfer electric field for electrostatically moving the toner image from the secondary transfer facing roller side to the secondary transfer roller side in the secondary transfer nip between the secondary transfer facing roller and the secondary transfer roller. Then, with the secondary transfer electric field and a nip pressure, the toner image on the intermediate transfer belt is secondary-transferred onto a recording sheet serving as the recording medium (also referred to as a transfer sheet) transported to the secondary transfer nip in synchronization with the arrival of the toner image on the intermediate transfer belt.

If the thus-configured image forming apparatus uses a recording sheet with large surface irregularities, such as traditional Japanese paper, an uneven density pattern mirroring the surface irregularities is likely to appear in the image. The uneven density pattern is due to a failure to transfer a sufficient amount of toner to recesses in a surface of the recording sheet, making the image density lower in the recesses than in projections on the surface of the recording sheet. To address this issue, the image forming apparatus may be configured to supply not a secondary transfer bias including only a direct-current (DC) voltage but a secondary transfer bias consisting of a superimposed bias having a DC voltage superimposed with an alternating-current (AC) voltage. With such a secondary transfer bias, the appearance of the uneven density pattern is minimized more than with the secondary transfer bias including only the DC voltage.

To secondary-transfer the toner image transferred to the intermediate transfer member onto the recording sheet, the secondary transfer member such as the secondary transfer roller is normally disposed at a secondary transfer position facing a surface of the intermediate transfer member, thereby forming the secondary transfer nip between the intermediate transfer member and the secondary transfer member at the secondary transfer position. With the secondary transfer bias supplied to the secondary transfer nip, the toner image carried on the intermediate transfer member is electrostatically transferred onto the recording sheet in the secondary transfer nip.

With such a configuration, when the recording sheet is not present in the secondary transfer nip, the secondary transfer member is in contact with the surface of the intermediate transfer member. Conversely, when the recording sheet is present in the secondary transfer nip, the secondary transfer member is in contact with the rear surface of the recording sheet. Therefore, if toner on the surface of the intermediate transfer member adheres to a surface of the secondary transfer member when the recording sheet is absent in the secondary transfer nip, the toner may later adhere to the rear surface of the recording sheet, contaminating the rear surface of the recording sheet.

To prevent such contamination of the rear surface of the recording sheet, the image forming apparatus may employ a bias cleaning system to clean off the toner adhering to the secondary transfer member, without providing a cleaning device for cleaning the secondary transfer member. According to the bias cleaning system, the toner adhering to the secondary transfer member is transferred to the surface of the intermediate transfer member by a cleaning bias supplied to a secondary transfer area at a predetermined time when image formation is not taking place (e.g., before or after an image forming job), and then the toner is cleaned off by a cleaning mechanism for cleaning the intermediate transfer member.

The bias cleaning system is capable of minimizing or preventing altogether contamination of the rear surface of the recording sheet without providing the cleaning device for the secondary transfer member, and thus is advantageous in terms of a reduction in size and cost of the image forming apparatus. The bias cleaning may be performed by supplying a negative cleaning bias, which is the same as a transfer bias for transferring the toner image from the intermediate transfer member to the recording sheet, and a positive cleaning bias opposite in polarity to the negative cleaning bias. Further, the image forming apparatus may be configured to change cleaning bias supply conditions in accordance with the usage of the image forming apparatus based on the result of detection of the toner image on the intermediate transfer member to perform an appropriate amount of cleaning on the secondary transfer member.

To supply the above-described superimposed bias, however, the image forming apparatus requires a circuit for supplying the AC component. If the circuit for supplying the AC component is included in the power supply, however, a load caused by the circuit delays the rise of the DC component. Particularly if the circuit for supplying the AC component includes a capacitor, the delay in rise of the DC component is prominent. The delay of the rise time reduces the time for supplying the voltage necessary for the bias cleaning of the transfer member, which may result in insufficient cleaning and thus the contamination of the rear surface of the recording sheet in a printing operation.

To ensure sufficient cleaning performance by quickening the rise of the DC component, the image forming apparatus may be configured to output the DC component in two stages at the rise thereof. This configuration, however, increases the cost of the power supply, which increases the overall cost of the image forming apparatus. Increasing the cost of the power supply despite a low frequency of the bias cleaning of the transfer member is uneconomical. Alternatively, the overall supply time of the cleaning bias may be increased to ensure the time for the bias cleaning. In this case, there is no increase in cost of the power supply, but the bias supply time in the image transfer is also increased. Since the image transfer is frequently performed, the increase of the bias supply time in the image transfer reduces image transfer productivity.

Further, the image forming apparatus may be configured to output a large bias to improve the bias cleaning performance. This configuration, however, also causes the increase in cost of the power supply and thus the increase in overall cost of the image forming apparatus. Increasing the cost of the power supply despite the low frequency of the bias cleaning of the transfer member is uneconomical, as described above. Further, if the overall supply time of the large bias is increased, there is no increase in cost of the power supply, but the bias supply time in the image transfer process is also increased, reducing image transfer productivity owing to the high frequency of the image transfer.

SUMMARY

The present invention provides an improved image forming apparatus that, in one example, includes an image carrier, a transfer member, a power supply, and a control device. The image carrier carries a toner image. The transfer member forms a transfer nip between the image carrier and the transfer member. The power supply outputs a superimposed bias having a direct-current component superimposed with an alternating-current component and a direct-current bias consisting only of a direct-current component. The control device controls the power supply to output the superimposed bias or the direct-current bias to transfer the toner image on the image carrier onto a recording medium in the transfer nip. The control device controls the power supply to alternately output a first bias corresponding to a direct-current component the same in polarity as the direct-current bias and a second bias corresponding to a direct-current component opposite in polarity to the direct-current bias to clean the transfer member when image formation is not taking place. The first bias is output with a target output value set in two stages including a first stage and a second stage lower than the first stage. The second bias is output with a target output value set in one stage. An output time of the second bias is longer than an output time of the first bias.

The present invention further provides another improved image forming apparatus that, in one example, includes an image carrier, a transfer member, a power supply, and a control device. The image carrier carries a toner image. The transfer member forms a transfer nip between the image carrier and the transfer member. The power supply outputs a superimposed bias having a direct-current component superimposed with an alternating-current component and a direct-current bias consisting only of a direct-current component. The control device controls the power supply to output the superimposed bias or the direct-current bias to transfer the toner image on the image carrier onto a recording medium in the transfer nip. The control device controls the power supply to alternately output a first bias corresponding to a direct-current component the same in polarity as the direct-current bias and a second bias corresponding to a direct-current component opposite in polarity to the direct-current bias to clean the transfer member when image formation is not taking place. A target output value of the first bias is larger than a target output value of the second bias, and an output time of the second bias is longer than an output time of the first bias.

The present invention further provides another improved image forming apparatus that, in one example, includes an image carrier, a transfer member, a power supply, and a control device. The image carrier carries a toner image. The transfer member forms a transfer nip between the image carrier and the transfer member. The power supply outputs a superimposed bias having a direct-current component superimposed with an alternating-current component and a direct-current bias consisting only of a direct-current component. The control device controls the power supply to output the superimposed bias or the direct-current bias to transfer the toner image on the image carrier onto a recording medium in the transfer nip. The control device controls the power supply to alternately output a first bias corresponding to a direct-current component the same in polarity as the direct-current bias and a second bias corresponding to a direct-current component opposite in polarity to the direct-current bias to clean the transfer member when image formation is not taking place. The first bias is larger than the second bias, and an output time of the second bias is longer than an output time of the first bias.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
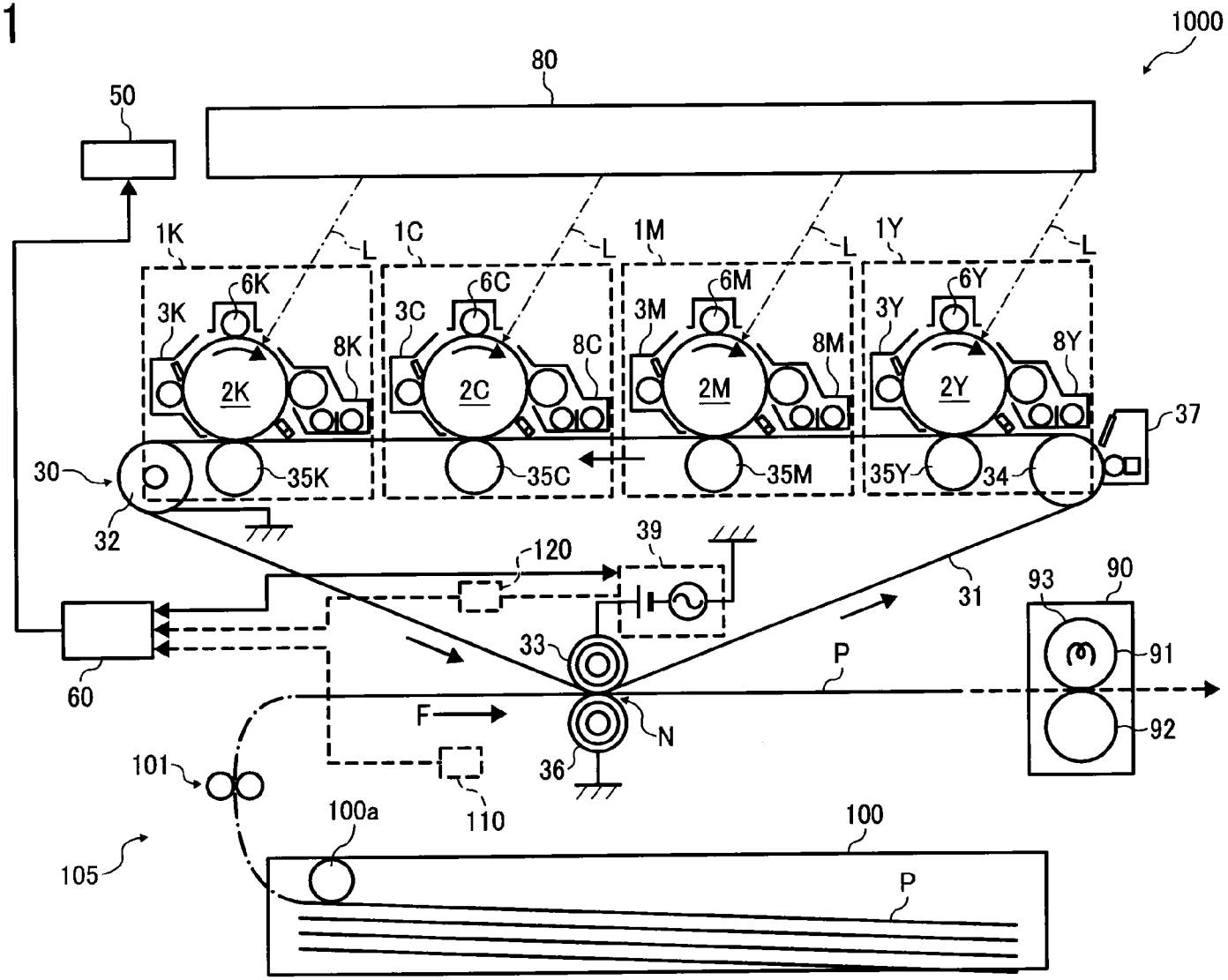
FIG. 1 is a schematic configuration diagram of a printer as an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

FIG. 1 is a diagram illustrating a schematic configuration of an electrophotographic color printer (hereinafter simply referred to as the printer) 1000 as an image forming apparatus according to an embodiment of the present invention.

In FIG. 1, the printer 1000 includes four image forming units 1Y, 1M, 1C, and 1K for forming toner images of yellow (Y), magenta (M), cyan (C), and black (K) colors, a transfer unit 30 serving as a transfer device, an optical writing unit 80, a fixing device 90, a sheet feeding unit 105, a control unit 60 serving as a control device, an operation panel 50, a power supply 39 for secondary transfer, and so forth.

The four image forming units 1Y, 1M, 1C, and 1K are similar in configuration except for toners of different colors yellow, magenta, cyan, and black used therein as image forming materials. Each of the image forming units 1Y, 1M, 1C, and 1K is replaced with a new image forming unit when the life thereof expires.

Figure 2:
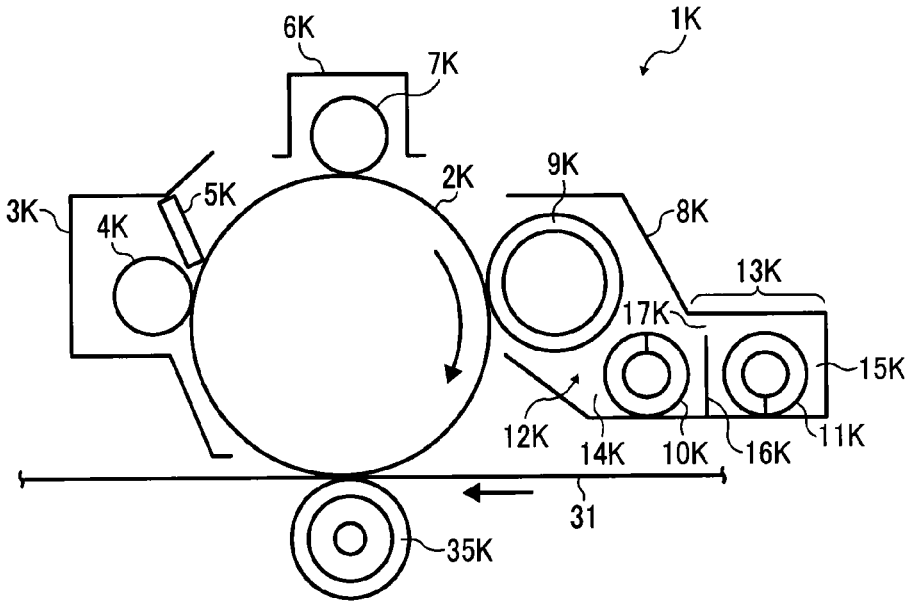
FIG. 2 is an enlarged view of a schematic configuration of an image forming unit for black color included in the printer in FIG. 1.

FIG. 2 is an enlarged view of a schematic configuration of the image forming unit 1K for the black color included in the printer 1000 in FIG. 1. As illustrated in FIG. 2, the image forming unit 1K for forming the black toner image, for example, includes a drum-shaped photoconductor 2K serving as an image carrier, a drum cleaning device 3K, a discharging device (not illustrated), a charging device 6K, and a development device 8K. These constituent components of the image forming unit 1K are held in the same casing to be integrally attachable to and detachable from a main body of the printer 1000, allowing the constituent components to be replaced at the same time. The other image forming units 1Y, 1M, and 1C similarly include photoconductors 2Y, 2M, and 2C, drum cleaning devices 3Y, 3M, and 3C, discharging devices (not illustrated), charging devices 6Y, 6M, and 6C, and development devices 8Y, 8M, and 8C, respectively.

The photoconductor 2K is constructed of a drum-shaped base member and an organic photosensitive layer formed on the outer circumferential surface of the base member. The photoconductor 2K is driven to rotate clockwise in FIG. 2 by a not-illustrated drive device. The charging device 6K includes a charging roller 7K serving as a charging member and supplied with a charging bias. The charging device 6K brings the charging roller 7K into contact or proximity with the photoconductor 2K to cause discharge between the charging roller 7K and the photoconductor 2K and thereby uniformly charge the outer circumferential surface of the photoconductor 2K. In the present printer 1000, the outer circumferential surface of the photoconductor 2K is uniformly charged to negative polarity the same as normal toner charging polarity, more specifically to approximately −650 V. In the present embodiment, a direct-current (DC) voltage (which may alternatively be controlled as a direct current) superimposed with an alternating-current (AC) voltage is used as the charging bias. The charging roller 7K is constructed of a tubular metal core and a conductive elastic layer made of a conductive elastic material and covering the outer circumferential surface of the core tube.

The above-described charging system that brings the charging roller 7K serving as the charging member into contact or proximity with the photoconductor 2K may be replaced by a charging system using a charger.

The outer circumferential surface of the photoconductor 2K uniformly charged by the charging device 6K is then subjected to optical scanning with a laser beam L emitted from the optical writing unit 80, to thereby carry an electrostatic latent image for the black color. The potential of the electrostatic latent image for the black color is approximately −100 V. The electrostatic latent image for the black color is developed by the development device 8K with a not-illustrated black toner, to thereby form a black toner image. The black toner image is then primary-transferred onto a later-described endless intermediate transfer belt 31 of the transfer unit 30, which serves as a belt-shaped image carrier and an intermediate transfer member.

The drum cleaning device 3K removes any post-transfer residual toner adhering to the outer circumferential surface of the photoconductor 2K after the primary transfer process, i.e., after the photoconductor 2K passes through a later-described primary transfer nip. The drum cleaning device 3K includes a cleaning brush roller 4K driven to rotate and a cleaning blade 5K having a cantilever-supported end and a free end contacted against the photoconductor 2K. In the drum cleaning device 3K, the rotating cleaning brush roller 4K scrapes the post-transfer residual toner from the outer circumferential surface of the photoconductor 2K, and the cleaning blade 5K scrapes the post-transfer residual toner off the outer circumferential surface of the photoconductor 2K. The cleaning blade 5K is contacted against the photoconductor 2K in a counter direction, with the cantilever-supported end located downstream of the free end in the rotation direction of the photoconductor 2K.

The above-described discharging device (not illustrated) discharges residual charge remaining on the photoconductor 2K after the cleaning by the drum cleaning device 3K. With the discharging process, the outer circumferential surface of the photoconductor 2K is initialized to prepare for the next image formation.

The development device 8K includes a development section 12K housing a development roller 9K and a developer transport section 13K for transporting a not-illustrated black developer. The developer transport section 13K includes a first transport chamber 14K housing a first screw 10K and a second transport chamber 15K housing a second screw 11K. Each of the first screw 10K and the second screw 11K includes a rotary shaft and a helical blade. The rotary shaft has opposed end portions in the axial direction thereof rotatably supported by shaft bearings, and the helical blade helically projects from the outer circumferential surface of the rotary shaft.

The first transport chamber 14K housing the first screw 10K and the second transport chamber 15K housing the second screw 11K are divided by a dividing wall 16K. Opposed end portions of the dividing wall 16K in the axial direction of the first screw 10K and the second screw 11K are formed with communication ports 17K allowing the first transport chamber 14K and the second transport chamber 15K to communicate with each other. As the first screw 10K holding the black developer with the helical blade is driven to rotate, the first screw 10K transports the black developer from the distal side toward the proximal side of the drawing in a direction perpendicular to the drawing plane, while stirring the black developer in the rotation direction of the first screw 10K. The first screw 10K and the development roller 9K are disposed parallel to each other and facing each other. Thus, the transport direction of the black developer extends along the rotational axis of the development roller 9K. The first screw 10K supplies the black developer to the outer circumferential surface of the development roller 9K along the axial direction thereof.

The black developer transported to an end portion of the first screw 10K on the proximal side of the drawing enters the second transport chamber 15K through the communication port 17K provided in the end portion of the dividing wall 16K on the proximal side of the drawing, and is held by the helical blade of the second screw 11K. Then, as the second screw 11K is driven to rotate, the black developer is transported from the proximal side toward the distal side of the drawing while being stirred in the rotation direction of the second screw 11K.

The second transport chamber 15K houses a not-illustrated toner concentration sensor provided to a lower wall of the casing of the development device 8K to detect the concentration of the black toner in the black developer in the second transport chamber 15K. In the present embodiment, the toner concentration sensor for the black toner is a magnetic permeability sensor, and the black developer is a so-called two-component developer containing the black toner and magnetic carrier. Since the magnetic permeability of the black developer is correlated with the concentration of the black toner, the magnetic permeability sensor detects the concentration of the black toner.

The present printer 1000 also includes not-illustrated toner supply devices for the yellow, magenta, cyan, and black colors to separately supply the yellow, magenta, cyan, and black toners to the respective second transport chambers 15K of the development devices 8Y, 8M, 8C, and 8K for the yellow, magenta, cyan, and black colors. The control unit 60 of the printer 1000 includes a random access memory (RAM) 60*c* illustrated in FIG. 10, which stores target voltage values Vtref for the yellow, magenta, cyan, and black colors to be output from the toner concentration sensors for the yellow, magenta, cyan, and black colors. If the difference between the value of the voltage output from each of the toner concentration sensors for the yellow, magenta, cyan, and black colors and the corresponding one of the target voltage values Vtref for the yellow, magenta, cyan, and black colors exceeds a predetermined value, the corresponding one of the toner supply devices for the yellow, magenta, cyan, and black colors is driven for a length of time needed to make good the difference. Thereby, the yellow, magenta, cyan, and black toners are supplied in controlled amounts to the second transport chambers 15K of the development devices 8Y, 8M, 8C, and 8K for the yellow, magenta, cyan, and black colors.

The development roller 9K housed in the development section 12K faces the first screw 10K, and also faces the photoconductor 2K through an opening formed in the casing of the development device 8K. The development roller 9K includes a tubular development sleeve, which is a non-magnetic pipe configured to be driven to rotate, and a magnet roller fixed inside the development sleeve not to rotate with the development sleeve. With the rotation of the development sleeve, the black developer supplied by the first screw 10K is transported to a development area facing the photoconductor 2K by the development roller 9K, while being carried on the outer circumferential surface of the development sleeve with the magnetic force of the magnet roller.

The development sleeve is supplied with a development bias of the same polarity as the polarity of the toner. The development bias is higher than the potential of the electrostatic latent image on the photoconductor 2K and lower than the potential of the area of the uniformly charged outer circumferential surface of the photoconductor 2K excluding the electrostatic latent image. Therefore, a development potential for electrostatically moving the black toner on the development sleeve toward the electrostatic latent image acts between the development sleeve and the electrostatic latent image on the photoconductor 2K. Further, a non-development potential for moving the black toner on the development sleeve toward the outer circumferential surface of the development sleeve acts between the development sleeve and a background area other than the electrostatic latent image of the photoconductor 2K. With the action of the development potential and the non-development potential, the black toner on the development sleeve is selectively transferred to the electrostatic latent image on the photoconductor 2K, thereby developing the electrostatic latent image to form the black toner image.

In the image forming units 1Y, 1M, and 1C for the yellow, magenta, and cyan colors in FIG. 1 described above, the yellow, magenta, and cyan toner images are respectively formed on the photoconductors 2Y, 2M, and 2C similarly as in the image forming unit 1K for the black color.

The optical writing unit 80 serving as a latent image writing device is disposed above the image forming units 1Y, 1M, 1C, and 1K. The optical writing unit 80 optically scans the photoconductors 2Y, 2M, 2C, and 2K with the laser beams L emitted from light sources such as laser diodes based on image information transmitted from an external device such as a personal computer. With the optical scanning, the electrostatic latent images for the yellow, magenta, cyan, and black colors are formed on the photoconductors 2Y, 2M, 2C, and 2K. Specifically, portions of the uniformly charged outer circumferential surfaces of the photoconductors 2Y, 2M, 2C, and 2K subjected to the laser beams L are reduced in potential, thereby forming the electrostatic latent images lower in potential than the background areas other than the electrostatic latent images. In the optical writing unit 80, the laser beams L emitted from the light sources are deflected in the main scanning direction by a polygon mirror driven to rotate by a polygon motor (not illustrated), and then are applied to the photoconductors 2Y, 2M, 2C, and 2K via a plurality of optical lenses and mirrors. The optical writing unit 80 may alternatively perform the optical writing on the photoconductors 2Y, 2M, 2C, and 2K with light emitting diode (LED) beams emitted from a plurality of LEDs of an LED array.

The transfer unit 30 is disposed under the image forming units 1Y, 1M, 1C, and 1K. The transfer unit 30 rotates the stretched endless intermediate transfer belt 31 counterclockwise in FIG. 1. In addition to the intermediate transfer belt 31 serving as an image carrier, the transfer unit 30 includes a drive roller 32, a repulsive roller 33, a cleaning backup roller 34, four primary transfer rollers 35Y, 35M, 35C, and 35K serving as primary transfer members, a secondary transfer roller 36 serving as a secondary transfer member, and a belt cleaning device 37.

The endless intermediate transfer belt 31 is stretched around the drive roller 32, the repulsive roller 33, the cleaning backup roller 34, and the four primary transfer rollers 35Y, 35M, 35C, and 35K disposed inside a loop of the intermediate transfer belt 31. In the present embodiment, the intermediate transfer belt 31 is rotated counterclockwise in FIG. 1 by the rotational force of the drive roller 32 driven to rotate counterclockwise in the drawing by a not-illustrated drive device.

The rotated intermediate transfer belt 31 is clamped between the primary transfer rollers 35Y, 35M, 35C, and 35K and the photoconductors 2Y, 2M, 2C, and 2K. Thereby, primary transfer nips for the yellow, magenta, cyan, and black colors are formed in which the outer circumferential surface of the intermediated transfer belt 31 is in contact with the photoconductors 2Y, 2M, 2C, and 2K. The primary transfer rollers 35Y, 35M, 35C, and 35K are respectively supplied with a primary transfer bias by power supplies 81Y, 81M, 81C, and 81K for primary transfer illustrated in FIG. 10, thereby forming primary transfer electric fields between the yellow, magenta, cyan, and black toner images on the photoconductors 2Y, 2M, 2C, and 2K and the primary transfer rollers 35Y, 35M, 35C, and 35K. As the photoconductor 2Y rotates, the yellow toner image formed on the outer circumferential surface of the photoconductor 2Y for the yellow color enters the primary transfer nip for the yellow color. Then, with the primary transfer electric field and a nip pressure, the yellow toner image is moved, i.e., primary-transferred, from the photoconductor 2Y onto the intermediate transfer belt 31. Thereafter, the intermediate transfer belt 31 bearing the yellow toner image thus primary-transferred thereto sequentially passes through the primary transfer nips for the magenta, cyan, and black colors. As a result, the magenta, cyan, and black toner images on the photoconductors 2M, 2C, and 2K are sequentially superimposed, i.e., primary-transferred, on the yellow toner image. With this superimposing primary transfer, four-color superimposed toner images are formed on the intermediate transfer belt 31.

Each of the primary transfer rollers 35Y, 35M, 35C, and 35K is an elastic roller consisting of a tubular metal core and a conductive sponge layer fixed on the outer circumferential surface of the core tube. The primary transfer rollers 35Y, 35M, 35C, and 35K are disposed with the axes thereof offset downstream of the axes of the photoconductors 2Y, 2M, 2C, and 2K by approximately 2.5 mm in the rotation direction of the intermediate transfer belt 31. In the present printer 1000, the thus-configured primary transfer rollers 35Y, 35M, 35C, and 35K are supplied with the primary transfer bias under constant current control. The primary transfer rollers 35Y, 35M, 35C, and 35K may be replaced by, for example, transfer chargers or transfer brushes as the primary transfer members.

The secondary transfer roller 36 of the transfer unit 30 is disposed outside the loop of the intermediate transfer belt 31 such that the intermediate transfer belt 31 is clamped between the secondary transfer roller 36 on the one hand and the repulsive roller 33 disposed inside the loop of the intermediate transfer belt 31 on the other. Thereby, a secondary transfer nip N is formed in which the outer circumferential surface of the intermediate transfer belt 31 is in contact with the secondary transfer roller 36. In the example illustrated in FIG. 1, the secondary transfer roller 36 is electrically grounded and the repulsive roller 33 is supplied with a secondary transfer bias voltage by the power supply 39 for secondary transfer to form a secondary transfer electric field for electrostatically moving the toner of negative polarity from the side of the repulsive roller 33 toward the side of the secondary transfer roller 36 between the repulsive roller 33 and the secondary transfer roller 36.

The sheet feeding unit 105 disposed below the transfer unit 30 includes a sheet feeding cassette 100, a sheet feed roller 101*a*, and a registration roller pair 101. The sheet feeding cassette 100 stores a sheet stack of a plurality of recording sheets P serving as recording media. The sheet feed roller 101*a* is in contact with a recording sheet P on the top of the sheet stack in the sheet feeding cassette 100. As the sheet feed roller 101*a* is driven to rotate with predetermined timing, the recording sheet P is sent to a sheet path indicated by a broken line in FIG. 1. Two rollers of the registration roller pair 101 disposed near an end of the sheet path rotate to receive the recording sheet P. Immediately after the rollers of the registration roller pair 101 clamp the recording sheet P transported thereto from the sheet feeding cassette 100, the rotation of the rollers of the registration roller pair 101 is stopped. Then, the rollers of the registration roller pair 101 are again driven to rotate to transport the clamped recording sheet P to the secondary transfer nip N such that the arrival of the recording sheet P synchronizes with the arrival of the four-color superimposed toner images on the intermediate transfer belt 31 in the secondary transfer nip N. The four-color superimposed toner images on the intermediate transfer belt 31 are brought into close contact with the recording sheet P in the secondary transfer nip N and secondary-transferred at the same time onto the recording sheet P with the secondary transfer electric field and a nip pressure, thereby forming a full-color toner image with the white color of the recording sheet P. The recording sheet P having the full-color toner image thus formed on a surface thereof passes through the secondary transfer nip N, and separates from the secondary transfer roller 36 and the intermediate transfer belt 31 owing to the curvature of the secondary transfer roller 36 and the intermediate transfer belt 31.

The repulsive roller 33 and the secondary transfer roller 36 each include a core tube and a conductive acrylonitrile butadiene rubber (NBR)-based rubber layer covering the outer circumferential surface of the core tube.

The power supply 39, which outputs the secondary transfer bias voltage for transferring the toner image on the intermediate transfer belt 31 onto the recording sheet P clamped in the secondary transfer nip N, includes a DC power supply and an AC power supply. The power supply 39 is configured to output, as the secondary transfer bias, a superimposed bias having a DC voltage superimposed with an AC voltage. In the present embodiment, the repulsive roller 33 is supplied with the secondary transfer bias, and the secondary transfer roller 36 is electrically grounded, as illustrated in FIG. 1.

Figure 3:
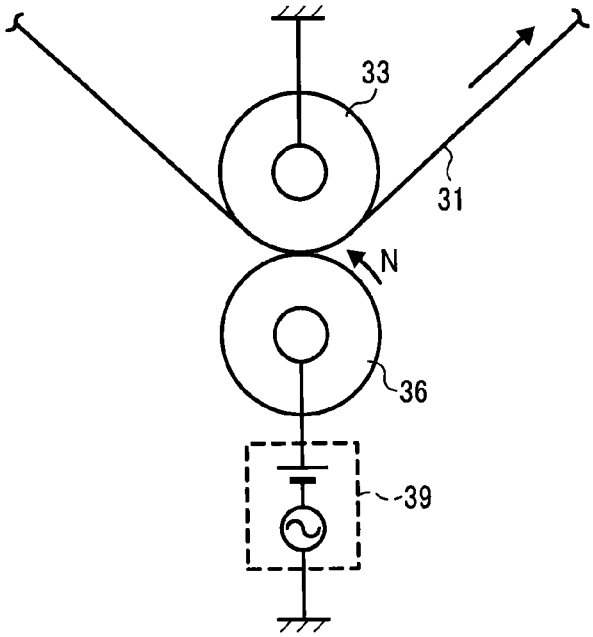
FIG. 3 is an enlarged view of a configuration of a power supply for secondary transfer and a voltage supply therefrom different from the configuration illustrated in FIG. 1.

The configuration that supplies the secondary transfer bias is not limited to the configuration illustrated in FIG. 1. For example, alternatively, the superimposed bias from the power supply 39 may be supplied to the secondary transfer roller 36, and the repulsive roller 33 may be electrically grounded, as illustrated in FIG. 3. In this case, the polarity of the DC voltage is changed. That is, in a configuration that supplies the superimposed bias to the repulsive roller 33 under the condition that the toner has negative polarity and the secondary transfer roller 36 is electrically grounded, as illustrated in FIG. 1, the DC voltage is set to negative polarity the same as the polarity of the toner, such that the time-average potential of the superimposed bias is of negative polarity the same as the polarity of the toner.

By contrast, in a configuration that supplies the superimposed bias to the secondary transfer roller 36 and electrically grounds the repulsive roller 33, as in the configuration illustrated in FIG. 3, the DC voltage is set to positive polarity opposite to the polarity of the toner such that the time-average potential of the superimposed bias is of positive polarity opposite to the polarity of the toner.

Figure 4:
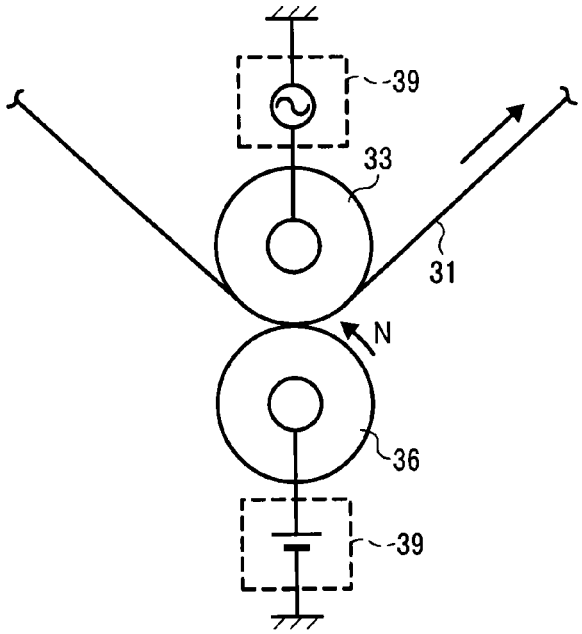
FIG. 4 is an enlarged view of another configuration of the power supply for secondary transfer and the voltage supply therefrom.
Figure 5:
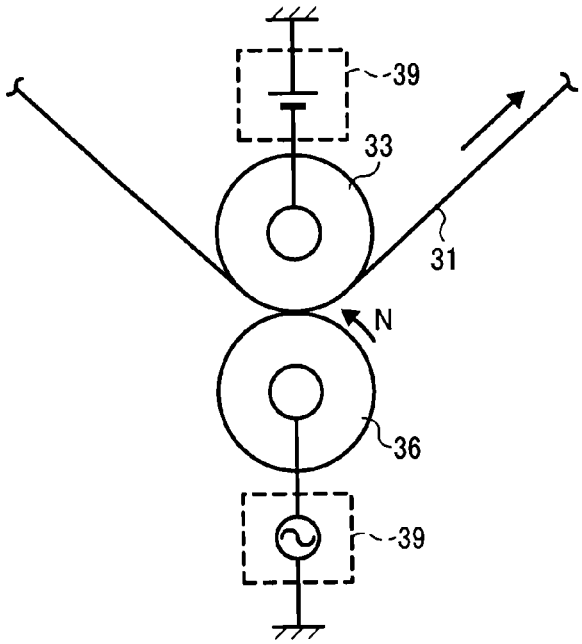
FIG. 5 is an enlarged view of another configuration of the power supply for secondary transfer and the voltage supply therefrom.

Further alternatively, the configuration that supplies the superimposed bias as the secondary transfer bias is not limited to the configuration that supplies the superimposed bias to one of the repulsive roller 33 and the secondary transfer roller 36. As illustrated in FIGS. 4 and 5, the DC voltage from the power supply 39 may be supplied to one of the repulsive roller 33 and the secondary transfer roller 36, and the AC voltage from the power supply 39 may be supplied to the other one of the repulsive roller 33 and the secondary transfer roller 36.

Figure 6:
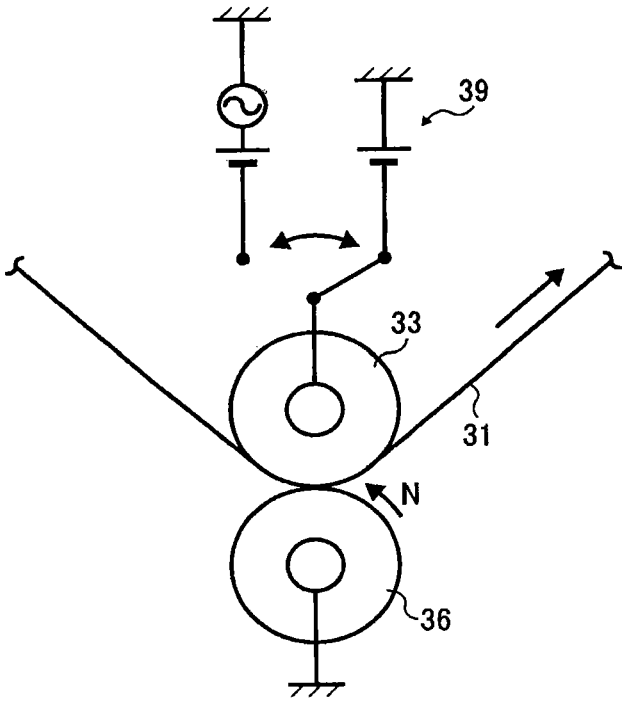
FIG. 6 is an enlarged view of another configuration of the power supply for secondary transfer and the voltage supply therefrom.
Figure 7:
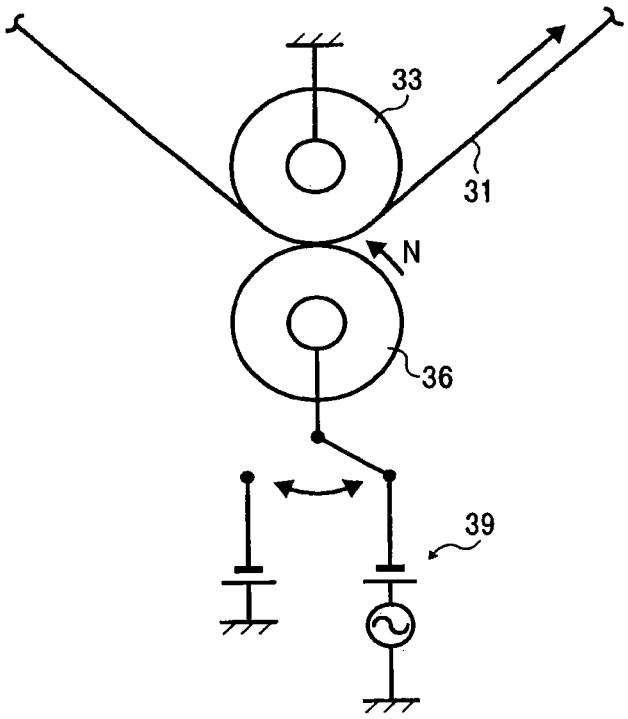
FIG. 7 is an enlarged view of another configuration of the power supply for secondary transfer and the voltage supply therefrom.

The configuration that supplies the secondary transfer bias is not limited to the above-described configurations. As illustrated in FIGS. 6 and 7, the combination of the DC voltage and the AC voltage and the DC voltage may be alternately supplied to one of the repulsive roller 33 and the secondary transfer roller 36. The configuration illustrated in FIG. 6 is capable of alternately supplying the combination of the DC voltage and the AC voltage and the DC voltage to the repulsive roller 33 from the power supply 39. The configuration illustrated in FIG. 7 is capable of alternately supplying the combination of the DC voltage and the AC voltage and the DC voltage to the secondary transfer roller 36 from the power supply 39.

Figure 8:
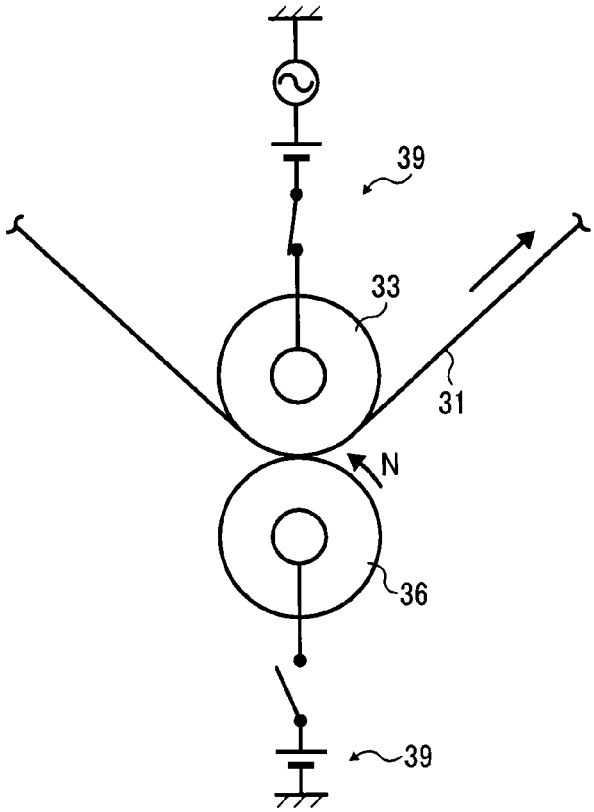
FIG. 8 is an enlarged view of another configuration of the power supply for secondary transfer and the voltage supply therefrom.
Figure 9:
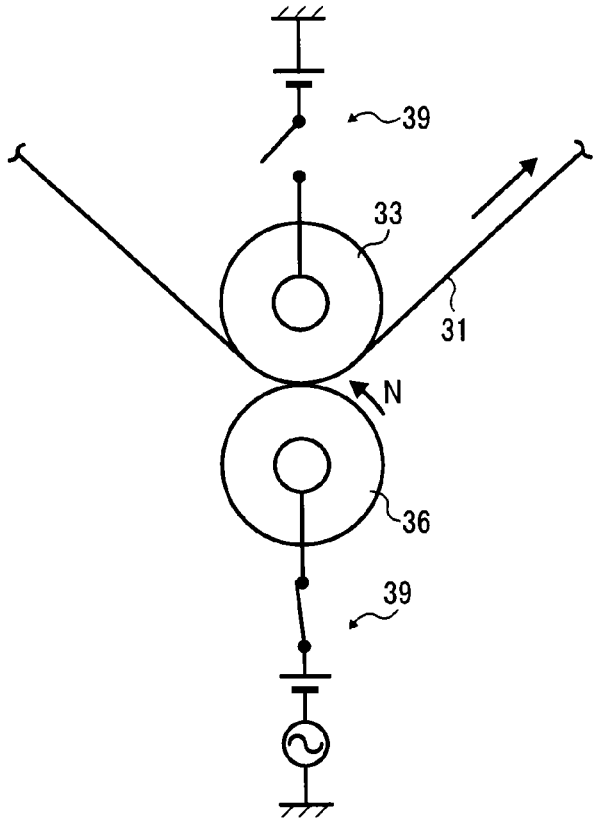
FIG. 9 is an enlarged view of another configuration of the power supply for secondary transfer and the voltage supply therefrom.

As illustrated in FIGS. 8 and 9, the configuration that supplies the secondary transfer bias by switching between the combination of the DC voltage and the AC voltage and the DC voltage may supply the combination of the DC voltage and the AC voltage to one of the repulsive roller 33 and the secondary transfer roller 36 and supply the DC voltage to the other one of the repulsive roller 33 and the secondary transfer roller 36 and appropriately switch the voltage supply therebetween. The configuration illustrated in FIG. 8 is capable of supplying the combination of the DC voltage and the AC voltage to the repulsive roller 33 and supplying the DC voltage to the secondary transfer roller 36. The configuration illustrated in FIG. 9 is capable of supplying the DC voltage to the repulsive roller 33 and supplying the combination of the DC voltage and the AC voltage to the secondary transfer roller 36.

As described above, there are various configurations that supply the secondary transfer bias to the secondary transfer nip N. In such configurations, the power supply may be selected as appropriate from among a power supply capable of supplying the combination of the DC voltage and the AC voltage, such as the power supply 39, a power supply capable of separately supplying the DC voltage and the AC voltage, and a power supply capable of alternately supplying the combination of the DC voltage and the AC voltage and the DC voltage, for example. In the present embodiment, the power supply 39 for secondary transfer is configured to switch between a first mode for outputting a secondary transfer bias including only a DC voltage (i.e., a DC bias) and a second mode for outputting a secondary transfer bias corresponding to a superimposed voltage having a DC voltage superimposed with an AC voltage. In the configurations illustrated in FIG. 1 and FIGS. 3 to 5, it is possible to switch between the first mode and the second mode by turning on or off the output of the AC voltage. In the configurations illustrated in FIGS. 6 to 9 the power supply 39 includes two power supplies switchable by a switching device such as a relay, and thus it is possible to switch between the first mode and the second mode by switching between the two power supplies.

If the recording sheet P has small surface irregularities such as those of plain paper, unlike large surface irregularities of rough paper, for example, an uneven density pattern mirroring the pattern of the surface irregularities does not appear in the image. In this case, therefore, the first mode is selected to supply the second transfer bias including only the DC voltage. If the recording sheet P has large surface irregularities such as those of rough paper, the second mode is selected to supply the second transfer bias corresponding to the DC voltage superimposed with the AC voltage. That is, the secondary transfer bias may be switched between the first mode and the second mode in accordance with the type (i.e., the size of the surface irregularities) of the recording sheet P to be used.

The intermediate transfer belt 31 having passed through the secondary transfer nip N has post-transfer residual toner adhering thereto, having failed to be transferred to the recording sheet P. The post-transfer residual toner is cleaned off the outer circumferential surface of the intermediate transfer belt 31 by the belt cleaning device 37 in contact with the outer circumferential surface of the intermediate transfer belt 31. The cleaning backup roller 34 disposed inside the loop of the intermediate transfer belt 31 backs up, from the inside of the loop, the cleaning of the intermediate transfer belt 31 performed by the belt cleaning device 37.

The fixing device 90 is disposed on the right side of FIG. 1 at a position downstream of the secondary transfer nip N in the direction of arrow F for transporting the recording sheet P. The fixing device 90 includes a fixing roller 91 and a pressure roller 92, which form a fixing nip. The fixing roller 91 includes a heat generation source 93 such as a halogen lamp. The pressure roller 92 rotates while being pressed against the fixing roller 91 with a predetermined pressure. The recording sheet P transported into the fixing device 90 is clamped in the fixing nip, with a surface of the recording sheet P carrying the unfixed toner image made in close contact with the fixing roller 91. Then, the toners in the toner image are softened with heat and pressure, and the full-color image is fixed on the recording sheet P. The recording sheet P discharged from the fixing device 90 is then discharged to the outside of the printer 1000 through a post-fixing transport path and a sheet discharging unit (not illustrated).

In the present printer 1000, a normal mode, a high image quality mode, and a high speed mode are settable in the control unit 60. In the normal mode, the process linear velocity (i.e., the linear velocity of the photoconductors 2Y, 2M, 2C, and 2K and the intermediate transfer belt 31) is set to approximately 280 mm/s. In the high image quality mode, in which the image quality is given priority over the print speed, the process linear velocity is set to a lower value than in the normal mode. In the high speed mode, in which the print speed is given priority over the image quality, the process linear velocity is set to a higher value than in the normal mode. Switching between the normal mode, the high image quality mode, and the high speed mode is performed based on an operation performed on keys of the operation panel 50 of the printer 1000 illustrated in FIGS. 1 and 10 or on a printer property menu displayed on a personal computer connected to the printer 1000.

To form a monochromatic image with the present printer 1000, a not-illustrated movable support plate supporting the primary transfer rollers 35Y, 35M, and 35C for the yellow, magenta, and cyan colors in the transfer unit 30 is moved to move the primary transfer rollers 35Y, 35M, and 35C away from the photoconductors 2Y, 2M, and 2C. Thereby, the outer circumferential surface of the intermediate transfer belt 31 is separated from the photoconductors 2Y, 2M, and 2C and kept in contact only with the photoconductor 2K for the black color. Among the image forming units 1K, 1M, 1C, and 1K, only the image forming unit 1K for the black color is driven in this state to form the black toner image on the photoconductor 2K.

In the present printer 1000, the value of the DC component of the secondary transfer bias is the same as a time-average voltage value Vave, i.e., the time-average value of the voltage of the DC component. The time-average voltage value Vave is obtained by dividing the total voltage over one period of the waveform of the voltage by the length of the period.

In the present printer 1000, in which the repulsive roller 33 is supplied with the secondary transfer bias and the secondary transfer roller 36 is electrically grounded, when the secondary transfer bias has negative polarity the same as the polarity of the toner, the toner of negative polarity is electrostatically moved from the side of the repulsive roller 33 to the side of the secondary transfer roller 36 in the secondary transfer nip N. Thereby, the toner on the intermediate transfer belt 31 is transferred onto the recording sheet P. Meanwhile, if the superimposed bias has positive polarity opposite to the polarity of the toner, the toner of negative polarity is electrostatically attracted to the side of the repulsive roller 33 from the side of the secondary transfer roller 36 in the secondary transfer nip N. Thereby, the toner transferred to the recording sheet P is returned to the intermediate transfer belt 31.

Figure 10:
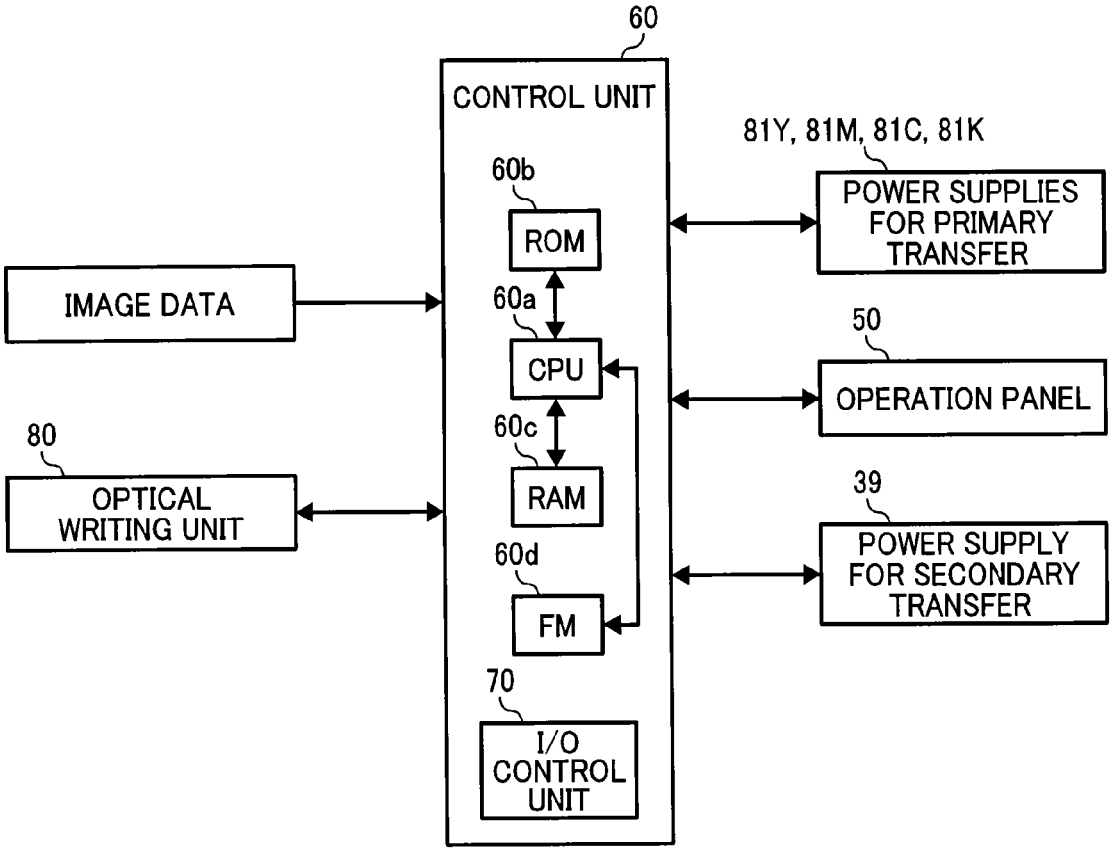
FIG. 10 is a block diagram illustrating a part of a control system of the printer illustrated in FIG. 1.

FIG. 10 is a block diagram illustrating a part of a control system of the printer 1000. In FIG. 10, the control unit 60 includes a central processing unit (CPU) 60*a* serving as an arithmetic device, the foregoing RAM 60*c* serving as a non-volatile memory, a read-only memory (ROM) 60*b* serving as a temporary storage device, a flash memory (FM) 60*d*, and a later-described input/output (I/O) control unit 70. The control unit 60 that has overall control of the printer 1000 is electrically and communicably connected to various constituent devices and sensors of the printer 1000. It is to be noted that FIG. 10 illustrates only relevant constituent devices of the printer 1000.

The power supplies 81Y, 81M, 81C, and 81K for primary transfer output the primary transfer bias to be supplied to the primary transfer rollers 35Y, 35M, 35C, and 35K. The power supply 39 for secondary transfer outputs the secondary transfer bias to be supplied to the secondary transfer nip N. In the configuration illustrated in FIG. 1, the power supply 39 outputs the secondary transfer bias to be supplied to the repulsive roller 33. The power supply 39 and the control unit 60 cooperate as a transfer bias output device. The operation panel 50 includes a touch panel and a plurality of key buttons (not illustrated). The operation panel 50 is capable of displaying an image on a screen of the touch panel, and receives an input operation performed on the touch panel or the key buttons and transmits input information to the control unit 60. The operation panel 50 is also capable of displaying an image on the touch panel based on a control signal transmitted from the control unit 60.

If the recording sheet P has large surface irregularities such as those of traditional Japanese paper, the uneven density pattern mirroring the surface irregularities is likely to appear in the image, as described above. As a measure for preventing such an uneven density pattern, it is effective to supply, as the transfer bias, the superimposed bias having the DC voltage superimposed with the AC voltage. A power supply configuration capable of supplying the superimposed bias, however, delays the rise of the DC component. The delayed rise of the DC component (i.e., a DC bias) results in degraded cleaning performance in the bias cleaning of the transfer member. Although there is a configuration for quickening the rise of the DC component, such a configuration increases the cost of the power supply. Further, if an overall supply time of the bias is increased to ensure sufficient bias cleaning performance, image transfer productivity is reduced.

In view of the above, embodiments of the present invention are configured to improve the cleaning performance of the bias cleaning while maximizing the cost effectiveness of the power supply, and minimize the reduction in productivity of the image transfer.

More specifically, in embodiments of the present invention, a first bias corresponding to a DC component of the same polarity as the polarity for the image transfer (hereinafter simply referred to as the transfer polarity) and a second bias corresponding to a DC component of the opposite polarity to the transfer polarity are alternately supplied to the transfer member in the bias cleaning of the transfer member. In a first embodiment of the present embodiment, the power supply is controlled to output the DC component of the same polarity as the transfer polarity with a target output value set in two stages, including a first stage and a second stage lower than the first stage. The power supply is controlled to output the DC component of the opposite polarity to the transfer polarity with a target output value set in one stage, with a supply time (i.e., an output time) of the DC component of the opposite polarity to the transfer polarity set to be longer than a supply time (i.e., an output time) of the DC component of the same polarity as the transfer polarity in the alternating supply of the DC components.

Description will now be given of an example in which the secondary transfer roller 36 in the configuration in FIG. 1 serves as the transfer member to be subjected to the bias cleaning, the repulsive roller 33 in the secondary transfer nip N in the configuration of FIG. 1 serves as a transfer area, and a DC bias is supplied to the transfer area as the cleaning bias.

In a first example of the first embodiment, a cycle of supplying the repulsive roller 33 with the DC voltage of the same polarity as the transfer polarity for a time corresponding to 0.9 rotations of the secondary transfer roller 36 and then with the DC voltage of the opposite polarity to the transfer polarity for a time corresponding to 1.8 rotations of the secondary transfer roller 36 is repeated a predetermined number of times.

In the present embodiment, the secondary transfer roller 36 has a diameter of approximately 24.8 mm. Further, the DC voltage of the same polarity as the transfer polarity is set to −75 μA, and the DC voltage of the opposite polarity to the transfer polarity is set to +500 V. However, the voltages to be supplied are not limited thereto, and may be changed depending on the timing of the bias cleaning, the process linear velocity, and the environment.

Further, in the present embodiment, the predetermined number of times by which the polarity of the supplied voltage is switched is set to 4 before a printing operation, 1 after the printing operation, and 12 during a recovery operation from a jam. However, the predetermined number of times is not limited thereto, and may be changed depending on the process linear velocity and the environment.

In a second example of the first embodiment, the voltage supply times are the same as those of the first example, but two output control signals are used for the first stage, as described later, to prevent undershoot.

In the first and second examples of the first embodiment, the DC voltage of the opposite polarity to the transfer polarity is supplied for the time corresponding to 1.8 rotations of the secondary transfer roller 36. Therefore, at least the time corresponding to one rotation of the secondary transfer roller 36 is ensured after the rise of the DC voltage of the opposite polarity to the transfer polarity, i.e., after the rise to the voltage necessary for the bias cleaning, thereby allowing reliable bias cleaning.

Further, with the polarity switched during the bias cleaning of the secondary transfer roller 36 serving as the transfer member, not only normally charged toner but also inversely charged toner are cleaned off with the voltage of the same polarity as the transfer polarity. The secondary transfer roller 36 is subjected to the bias cleaning while in contact with the intermediate transfer belt 31 serving as the intermediate transfer member.

The bias cleaning of the transfer member may be performed at the following times: 1) a time after the start of the printing operation and before the entry of the first recording sheet P into the secondary transfer nip N, 2) a time before the completion of the printing operation and after the passage of the last recording sheet P through the secondary transfer nip N, 3) a time in which the printing operation is not taking place, and 4) a time after the start of the printing operation and between successive recording sheets P. In each of the above-described times, image formation is not taking place. Further, the bias cleaning operations in the respective times may be performed in combination, i.e., the bias cleaning may be repeatedly preformed.

The above-described time 3) in which the printing operation is not taking place may be one of the following two times: a) during a jam recovery operation of removing the recording sheet P jammed during the transport thereof from the sheet feeding unit 105 to the sheet discharging unit, and b) during an abnormal termination recovery operation of powering on the printer 1000 abnormally terminated by a large impact thereto or a power failure.

Further, when the cleaning bias is supplied during the time 3) in which the printing operation is not taking place, if the value of the DC component of the opposite polarity to the transfer polarity (i.e., positive polarity in the present embodiment) is set to be larger than the value of the DC component of the opposite polarity to the transfer polarity in the times 1), 2), and 4), impurities such as the toner adhering to the transfer member may be increased, but are reliably cleaned off. Specifically, the value of the DC component of the opposite polarity to the transfer polarity may be set to 1000 V in the time 3) and 500 V in the times 1), 2), and 4), for example.

Further, when the cleaning bias is supplied during the time 3) in which the printing operation is not taking place, if the number of cycles of switching between the opposite polarity to the transfer polarity and the same polarity as the transfer polarity is increased, impurities such as the toner adhering to the transfer member may be increased, but are reliably cleaned off. Specifically, the number of cycles of switching between the opposite polarity to the transfer polarity and the same polarity as the transfer polarity may be set to 12 in the time 3) and 4 in the times 1), 2), and 4), for example.

The above-described first and second examples of the first embodiment will now be compared with comparative examples.

Figure 11:
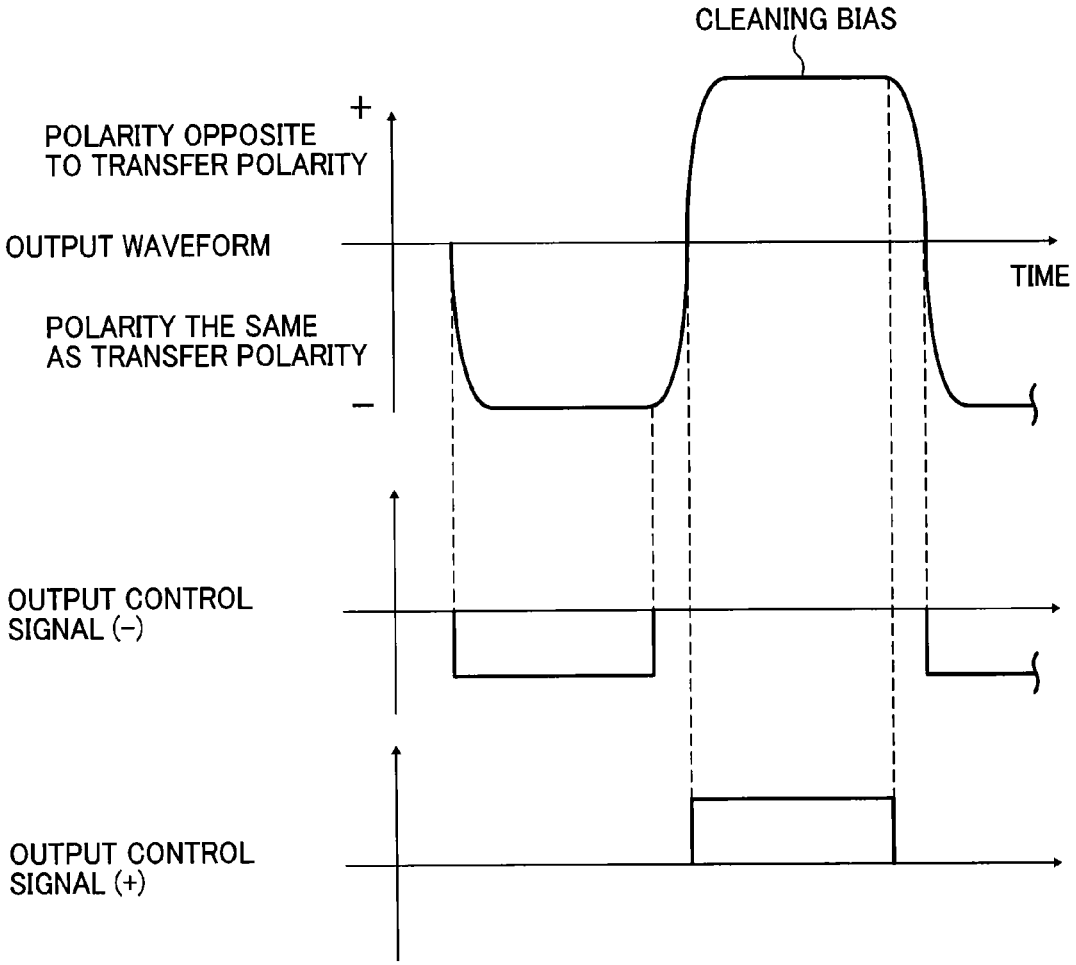
FIG. 11 RELATED ART
FIG. 11 is a waveform chart of a cleaning bias supplied in a first comparative example not equipped with an AC power supply.

FIG. 11 is a waveform chart of a cleaning bias and output control signals in a first comparative example in which the cleaning bias is supplied in an image forming apparatus not equipped with an AC power supply. In FIG. 11, the upper waveform corresponds to the current or voltage output to a repulsive roller of the image forming apparatus. The middle waveform corresponds to an output control signal of the same polarity as the transfer polarity. The lower waveform corresponds to an output control signal of the opposite polarity to the transfer polarity. The power supply of the first comparative example is configured not to supply the AC component. Therefore, the DC component quickly rises at a substantially sharp angle. Herein, the supply time of the DC component of the same polarity as the transfer polarity is the same as the supply time of the DC component of the opposite polarity to the transfer polarity. Due to the quick rise of the DC component, a sufficient time for supplying the voltage necessary for the bias cleaning is obtained.

Figure 12:
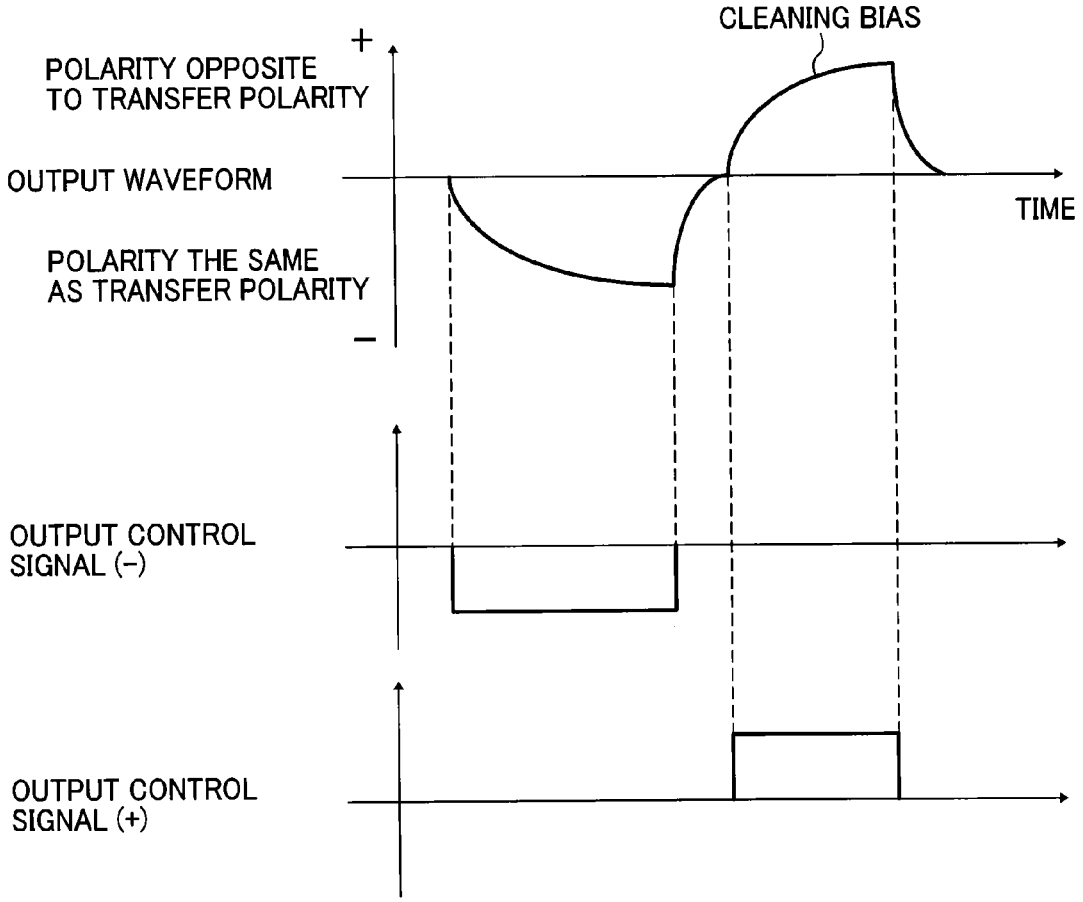
FIG. 12 RELATED ART
FIG. 12 is a waveform chart of a cleaning bias supplied in a second comparative example equipped with an AC power supply.

FIG. 12 is a waveform chart of a cleaning bias and output control signals in a second comparative example in which the cleaning bias is supplied in an image forming apparatus equipped with an AC power supply (i.e., having a power supply configured to supply the AC component), but the cleaning bias is supplied similarly as in the first example (i.e., with the supply time of the DC component of the same polarity as the transfer polarity set to be the same as the supply time of the DC component of the opposite polarity to the transfer polarity). In FIG. 12, the upper waveform corresponds to the current or voltage output to a repulsive roller of the image forming apparatus. The middle waveform corresponds to an output control signal of the same polarity as the transfer polarity. The lower waveform corresponds to an output control signal of the opposite polarity to the transfer polarity. The power supply of the second comparative example is configured to supply the AC component. Therefore, the rise of the DC component is delayed, and a sufficient time for supplying the voltage necessary for the bias cleaning is not obtained, causing contamination of the rear surface of a recording sheet P.

Figure 13:
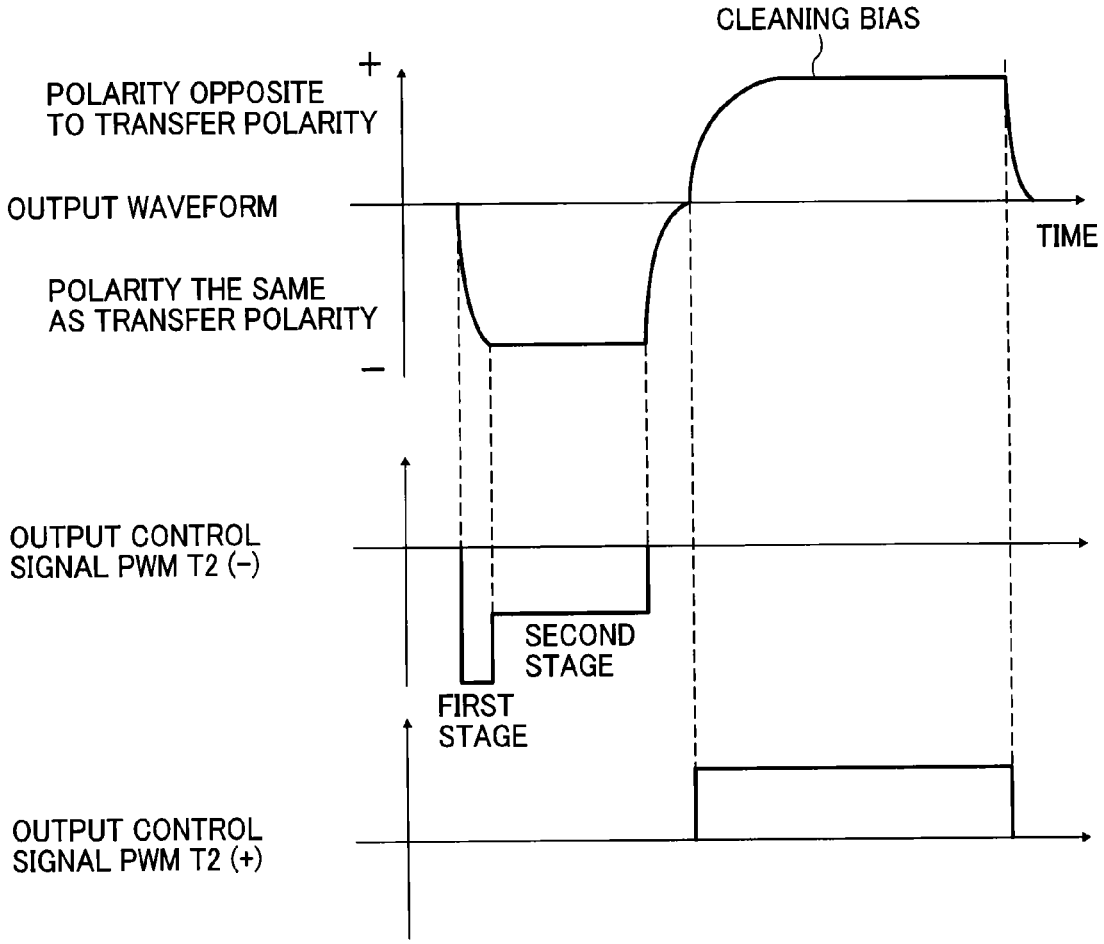
FIG. 13 is a waveform chart illustrating a cleaning bias supplied in a first example of a first embodiment of the present invention.

FIG. 13 is a waveform chart of a cleaning bias and output control signals supplied in the above-described first example of the first embodiment. In FIG. 13, the upper waveform corresponds to the current or voltage output to the repulsive roller 33. The middle waveform corresponds to an output control signal PWM T2(−) of the same polarity as the transfer polarity. The lower waveform corresponds to an output control signal PWM T2(+) of the opposite polarity to the transfer polarity. In the present embodiment, the DC component of the same polarity as the transfer polarity is raised in two stages. To raise the DC component of the same polarity as the transfer polarity in two stages, the output control signal PWM T2(−) starts to raise the DC component with a large target output value of the current or voltage, and then lowers the target output value of the current or voltage to a value suitable for the bias cleaning. Thereby, the DC component of the same polarity as the transfer polarity quickly rises, improving the cleaning effect.

The present embodiment is configured to use negative polarity as the toner charging polarity for normal charging and perform the image transfer by supplying the repulsive roller 33 with the transfer bias of negative polarity the same as the toner charging polarity, as in the configuration of FIG. 1 in which the DC bias is supplied to the secondary transfer nip N. Therefore, when the repulsive roller 33 is supplied with a bias of positive polarity opposite to the toner charging polarity for normal charging during the bias cleaning in the secondary transfer nip N in FIG. 1, the toner adhering to the secondary transfer roller 36 serving as the transfer member moves to the intermediate transfer belt 31.

In the first example of the first embodiment, due to the long supply time of the DC component of the opposite polarity to the transfer polarity, i.e., the DC component of positive polarity (+) in FIG. 13, a sufficient time for supplying the voltage necessary for the bias cleaning is ensured, allowing reliable bias cleaning. Further, due to the quick rise of the DC component of the same polarity as the transfer polarity, i.e., the DC component of negative polarity (−) in FIG. 13, the cleaning performance for cleaning the inversely charged toner and so forth is improved.

Figure 14:
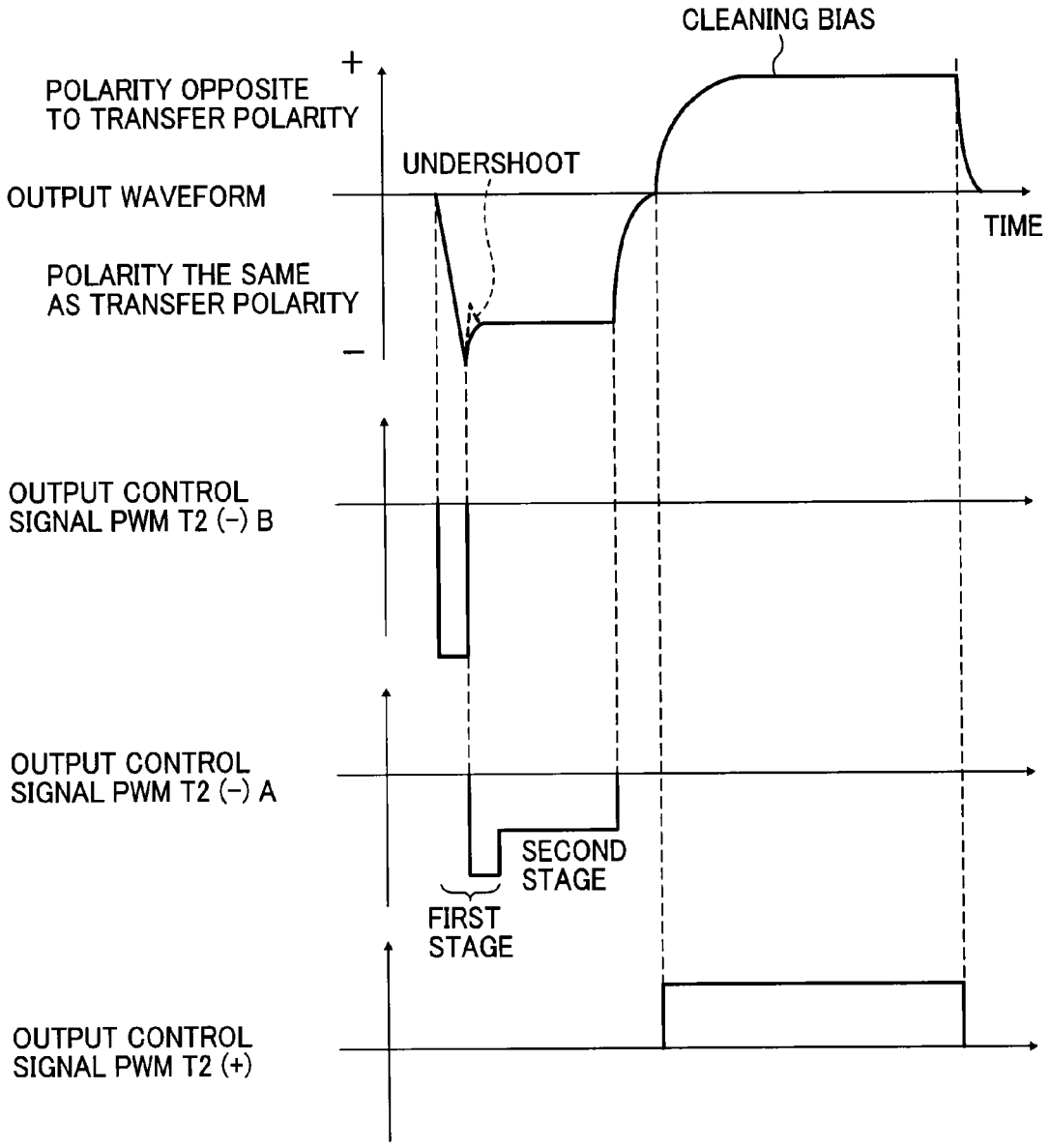
FIG. 14 is a waveform chart illustrating a cleaning bias supplied in a second example of the first embodiment of the present invention.

FIG. 14 is a waveform chart illustrating a cleaning bias and output control signals supplied in the above-described second example of the first embodiment. Herein, the DC component of the same polarity as the transfer polarity is raised in two stages similarly to the first example. The second example, however, is different from the first example in that the target output value of the first stage is controlled by two output control signals. That is, the bias for the rise to the first stage is first output by an output control signal PWM T2(−)B and then by an output control signal PWM T2(−)A. The DC component starts to rise with the target output value of the first output control signal PWM T2(−)B, which is larger than the target output value of the output control signal PWM T2(−) for the first stage in the first example, thereby attaining a faster rise of the DC component than in the first example. Further, the target output value of the next output control signal PWM T2(−)A is set to be smaller than the target output value of the first output control signal PWM T2(−)B (i.e., A<B), thereby preventing undershoot indicated by a virtual line in FIG. 14 from occurring during the shift from the first target output value to the second target output value, i.e., the shift from the large target output value to the small target output value. The second example of the first embodiment is capable of preventing the undershoot while attaining a faster rise of the DC component of the same polarity as the transfer polarity, i.e., the DC component of negative polarity (−) in FIG. 14.

The target output value of the output control signal PWM T2(−)B is the first target output value corresponding to a first period in the first stage of the rise. The target output value of the output control signal PWM T2(−)A is the second target output value corresponding to a second period following the first period in the first stage of the rise, which is different from the first target output value. That is, the target output value of the first stage of the rise includes the first target output value corresponding to the first period and the second target output value corresponding to the second period following the first period and different from the first target output value.

Figure 15:
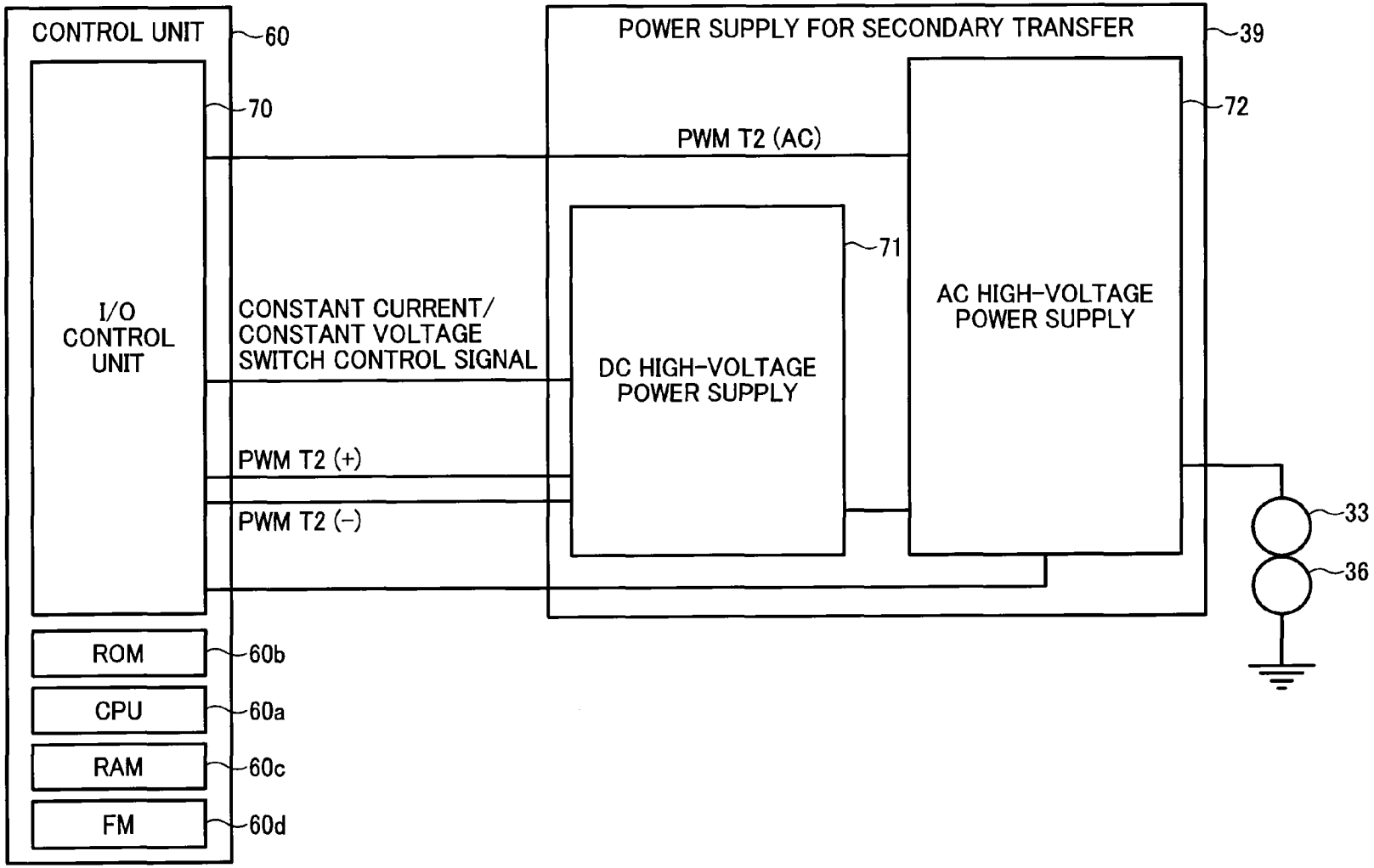
FIG. 15 is a block diagram illustrating a power supply configuration employed in the first example of the first embodiment.
Figure 16:
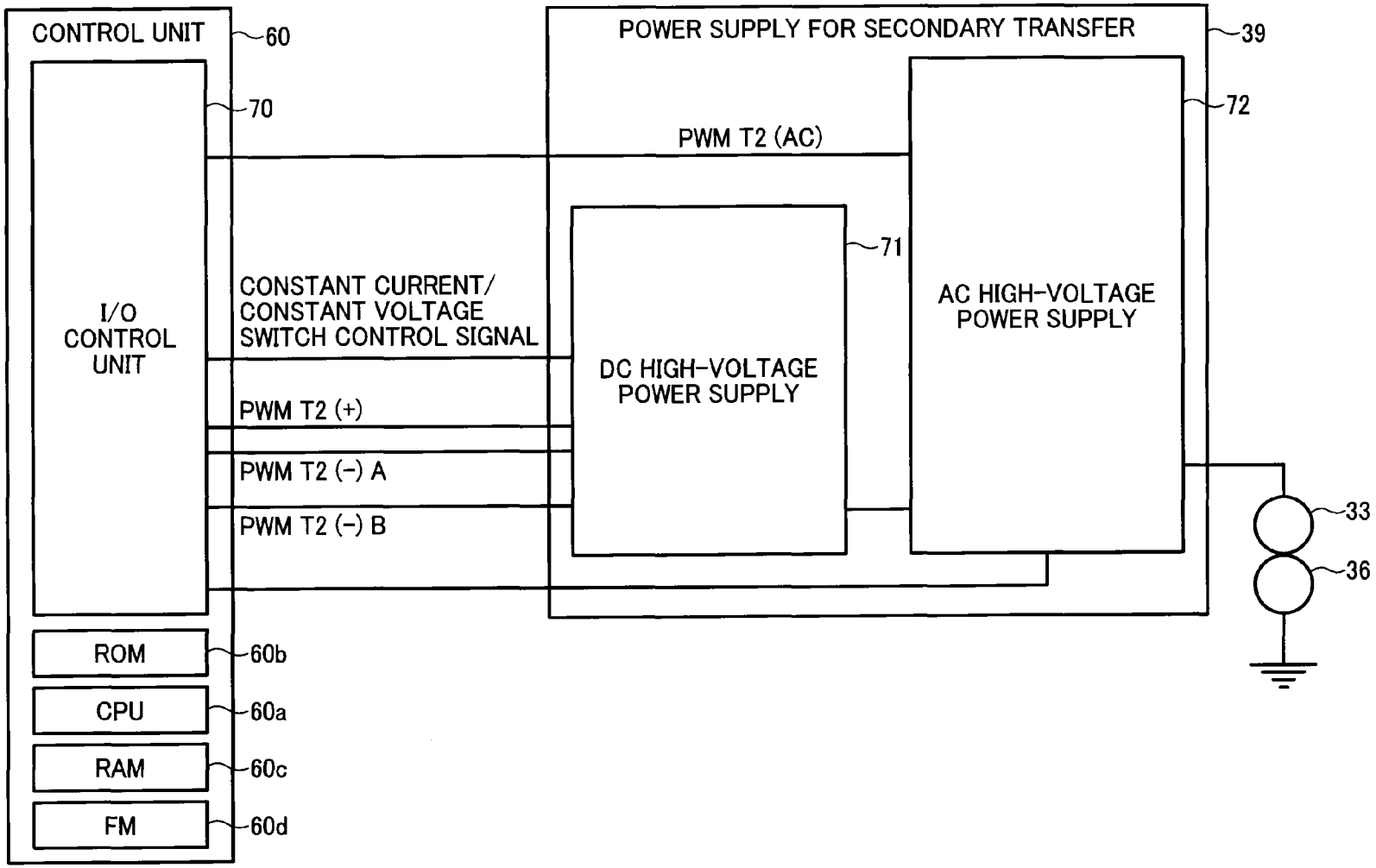
FIG. 16 is a block diagram illustrating a power supply configuration employed in the second example of the first embodiment.

FIG. 15 illustrates a power supply configuration employed in the first example of the first embodiment. FIG. 16 illustrates a power supply configuration employed in the second example of the first embodiment.

In the configuration in FIG. 15, the power supply 39 includes a DC high-voltage power supply 71 and an AC high-voltage power supply 72 to supply a DC bias and a superimposed bias having a DC bias superimposed with an AC bias. When supplying the cleaning bias, or when supplying the DC bias as the transfer bias, the DC high-voltage power supply 71 outputs a high voltage composed of a DC component based on the output control signal PWM T2(+) transmitted from the I/O control unit 70 of the control unit 60. When supplying the superimposed bias as the transfer bias, the DC high-voltage power supply 71 and the AC high-voltage power supply 72 output a high voltage composed of a DC component superimposed with a predetermined AC component based on the output control signal PWM T2(−) and an output control signal PWM T2(AC) transmitted from the I/O control unit 70. The present configuration outputs the two high voltages by switching between a constant voltage output and a constant current output in accordance with a constant current/constant voltage switch control signal transmitted from the I/O control unit 70. With the switching according to the control signal from the I/O control unit 70, a current flows from the repulsive roller 33 to the ground via the secondary transfer roller 36.

The configuration in FIG. 16 is different from the configuration in FIG. 15 in that separate signal lines are provided for the two output control signals PWM T2(−), i.e., PWM T2(−)A and PWM T2(−)B. The I/O control unit 70 outputs the output control signal PWM T2(−)B, which is for the first half of the first stage of the rise in the second example of the first embodiment, to the DC high-voltage power supply 71 via a signal line for the output control signal PWM T2(−)B. Further, the I/O control unit 70 outputs the output control signal PWM T2(−)A, which is for the second half of the first stage of the rise in the second example of the first embodiment, to the DC high-voltage power supply 71 via a signal line for the output control signal PWM T2(−)A.

To control the first stage and the second stage of the rise with a single output control signal, as in the first example of the first embodiment, it is necessary to make the maximum value (i.e., a duty ratio of 100%) of the target output value (i.e., duty ratio) of the output control signal correspond to the first stage, which corresponds to a large bias. It is therefore necessary to adjust the target output value of the second stage in a narrow range. In this case, a storage area in the control unit 60 is required to store numerical values having many digits for setting the target output values, and thus needs a large capacity.

In the second example of the first embodiment, the target output value of the DC component of the same polarity as the transfer polarity is controlled with the two separate output control signals PWM T2(−)A and PWM T2(−)B. It is therefore possible to reduce errors of the target output value, save the capacity of the storage area in the control unit 60, and prevent undershoot while outputting a large bias for the rise to the repulsive roller 33.

In the above-described configuration in FIG. 16, the signal line for the output control signal PWM T2(−)B and the signal line for the output control signal PWM T2(−)A are different. However, it is sufficient if the output control signals PWM T2(−)B and PWM T2(−)A output by the I/O control unit 70 are different. Thus, the same signal line may be used to transmit the output control signals PWM T2(−)B and PWM T2(−)A.

As described above, a configuration for quickening the rise of the DC component normally increases the cost of the power supply. More specifically, there are separate costs for quickening the rise of the DC component of the same polarity as the transfer polarity and for quickening the rise of the DC component of to the opposite polarity to the transfer polarity. To quicken the rise of the DC component in both the same polarity as the transfer polarity and the opposite polarity to the transfer polarity, therefore, the increase in cost of the power supply doubles.

Meanwhile, the first embodiment is configured to quicken the rise of the DC component in one of the polarities, i.e., the same polarity as the transfer polarity, thereby minimizing the increase in cost of the power supply. With this configuration, a large bias is output (i.e., the bias is output with a large target output value) at the rise of the DC component. Thereby, the DC component quickly rises, providing the effect of improving the cleaning performance of the bias cleaning. The quick rise of the DC component of the same polarity as the transfer polarity also improves the transfer performance of the image transfer in a tip portion of the recording sheet P (i.e., a tip portion of the image).

Further, in the bias cleaning according to the first embodiment, the supply time of the cleaning bias is increased in the opposite polarity to the transfer polarity. Accordingly, it is possible to ensure a sufficient time for supplying the voltage necessary for the bias cleaning while suppressing the increase in overall supply time of the cleaning bias, thereby allowing reliable bias cleaning. If the overall supply time of the cleaning bias is increased to improve the cleaning performance, the cost of the power supply is not increased, but the productivity of the frequently performed image transfer is reduced. According to the first embodiment, however, the supply time of the DC component of the opposite polarity to the transfer polarity is increased in the bias cleaning, which is performed less frequently than the image transfer. Consequently, the increase in supply time of the DC component of the opposite polarity to the transfer polarity does not affect image transfer productivity much.

As described above, the first embodiment improves the cleaning performance of the bias cleaning while maximizing the cost efficiency of the power supply by minimizing the increase in cost of the power supply, and minimizes the reduction in productivity of the image transfer.

TABLE 1 given below illustrates the results of experiments for checking the effect of bias cleaning performed on the secondary transfer roller 36. In the table illustrating levels of suppression of rear surface contamination, "poor" indicates noticeable contamination of the rear surface of the recording sheet P, "acceptable" indicates slight and negligible contamination of the rear surface of the recording sheet P, and "good" indicates no contamination of the rear surface of the recording sheet P.

TABLE 1

| | first comparative example (FIG. 11) | second comparative example (FIG. 12) | first embodiment example (FIG. 13) | second embodiment example (FIG. 14) |
|---|---|---|---|---|
| suppression of rear surface contamination | good | poor | acceptable | good |

In the experiments for checking the bias cleaning effect, the secondary transfer roller 36 serving as the secondary transfer member was previously contaminated with toner, specifically with a solid image of a toner of a given color transferred to the secondary transfer roller 36 in the absence of the recording sheet P. Then, a bias cleaning operation with the cleaning bias and a printing operation were sequentially performed. Thereafter, the contamination of the rear surface of the recording sheet P was checked.

As illustrated in TABLE 1, it is understood that even the configuration equipped with the AC power supply capable of supplying the AC component reliably cleans the secondary transfer roller 36 serving as the secondary transfer member, if the configuration employs the cleaning bias supply system according to the first or second example of the first embodiment.

In the experiments for checking the bias cleaning effect, the power supplies having the configurations illustrated in FIGS. 15 and 16 were employed as a bias supply device. Further, the experiments were performed at a temperature of 23° C. and a humidity of 50% with full-color PPC paper T6000 (70 W), i.e., high-quality paper for full-color copying manufactured by Ricoh Company, Ltd.

Description will now be given of a second embodiment of the present invention. In the second embodiment, the first bias corresponding to the DC component of the same polarity as the transfer polarity and the second bias corresponding to the DC component of the opposite polarity to the transfer polarity are alternately supplied to the transfer member in the bias cleaning of the transfer member. Further, in the second embodiment, the supply time (i.e., the output time) of the DC component of the opposite polarity to the transfer polarity is set to be longer than the supply time (i.e., the output time) of the DC component of the same polarity as the transfer polarity in the alternating supply of the DC components, and the target output value of the DC component of the same polarity as the transfer polarity is larger than the target output value of the DC component of the opposite polarity to the transfer polarity.

In the following description of the second embodiment, the power supplies having the configurations illustrated in FIGS. 15 and 16 are employed. The description will focus on cleaning bias output controls of the second embodiment different from those of the first embodiment, and redundant descriptions overlapping with the descriptions of the first embodiment will be omitted.

Figure 17:
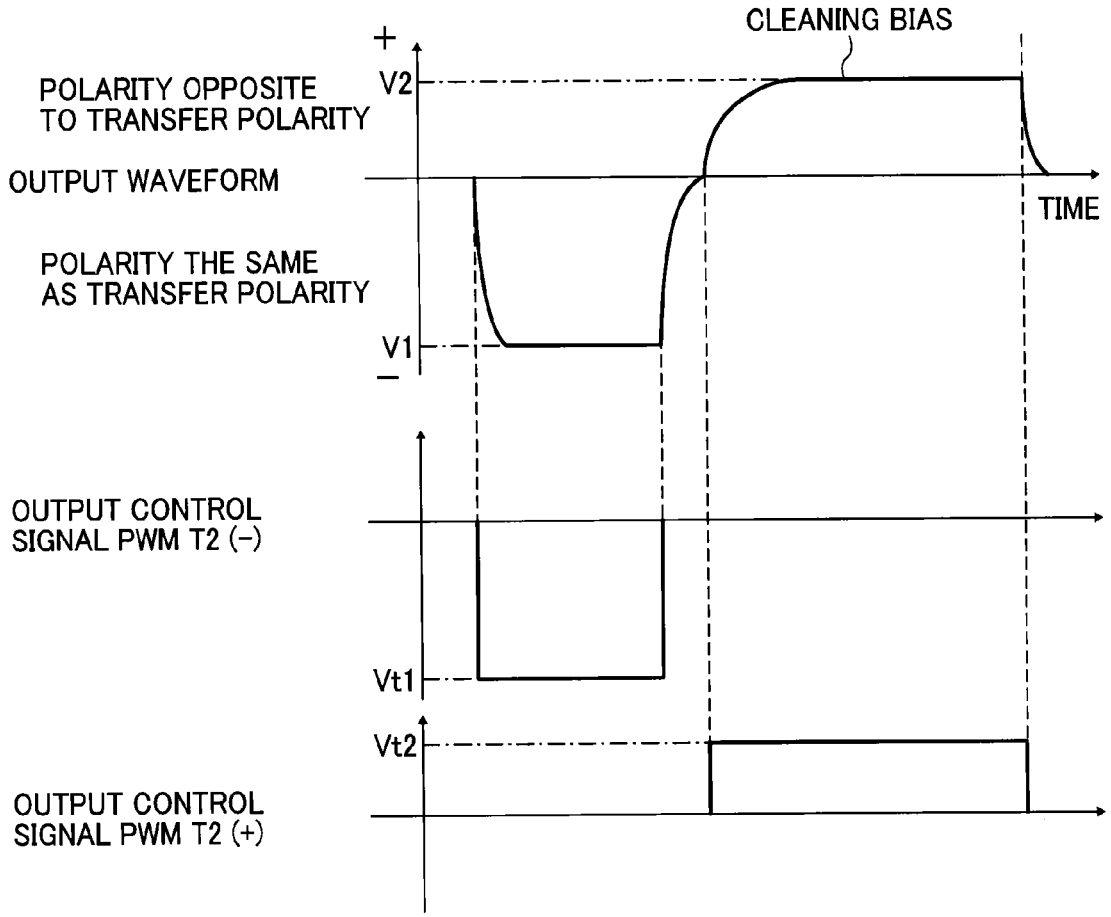
FIG. 17 is a waveform chart illustrating a cleaning bias output control in a first example of a second embodiment of the present invention.

FIG. 17 is a waveform chart illustrating a cleaning bias output control according to a first example of the second embodiment. The first example of the second embodiment employs the power supply configuration illustrated in FIG. 15.

In FIG. 17, the upper waveform corresponds to the current or voltage output to the repulsive roller 33. The middle waveform corresponds to the output control signal PWM T2(−) of the same polarity as the transfer polarity. The lower waveform corresponds to the output control signal PWM T2(+) of the opposite polarity to the transfer polarity. An absolute value |Vt1| of a target output value Vt1 of the output control signal PWM T2(−) of the same polarity as the transfer polarity is larger than an absolute value |Vt2| of a target output value Vt2 of the output control signal PWM T2(+) of the opposite polarity to the transfer polarity (i.e., |Vt1|>|Vt2|). In the actually output cleaning bias, therefore, an absolute value |V1| of a bias output V1 of the same polarity as the transfer polarity is larger than an absolute value |V2| of a bias output V2 of the opposite polarity to the transfer polarity (i.e., |V1|>|V2|).

In the cleaning bias supplied in the first example of the second embodiment, the supply time of the DC component of the opposite polarity to the transfer polarity is longer than the supply time of the DC component of the same polarity as the transfer polarity. Further, the absolute value |Vt1| of the target output value Vt1 is larger than the absolute value |Vt2| of the target output value Vt2, i.e., the absolute value |V1| of the bias output V1 of the same polarity as the transfer polarity is larger than the absolute value |V2| of the bias output V2 of the opposite polarity to the transfer polarity in the actually output cleaning bias. With this output control, a large output is obtained in the bias cleaning, thereby improving the cleaning performance of the bias cleaning and also the transfer performance of the image transfer. As to the cost of the power supply, the present example is configured to output a large bias in only one of the polarities, i.e., the same polarity as the transfer polarity, thereby minimizing the increase in cost of the power supply. Further, the increase of the supply time of the DC component of the opposite polarity to the transfer polarity does not affect image transfer productivity much, similarly as in the first embodiment.

Figure 18:
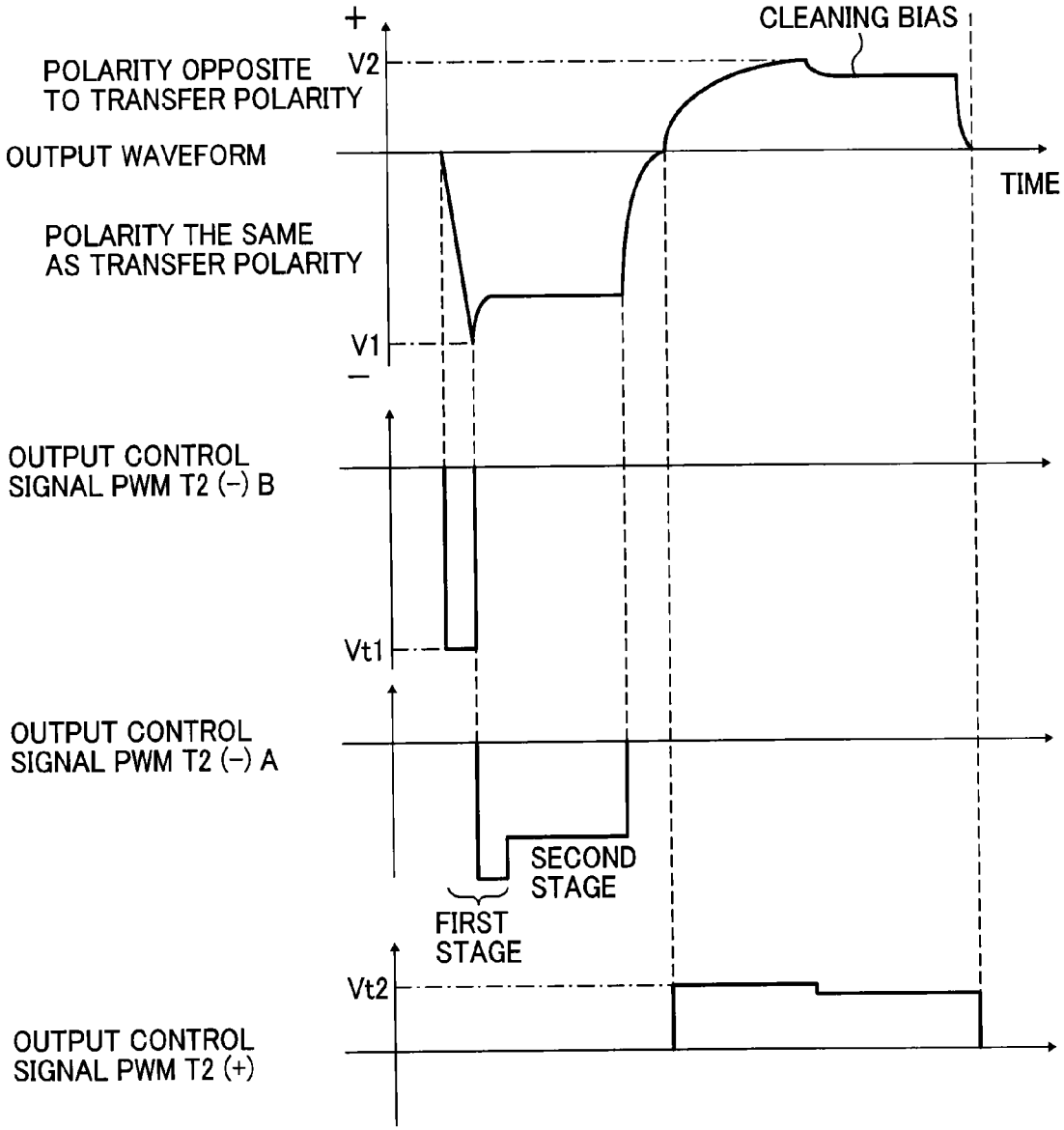
FIG. 18 is a waveform chart illustrating a cleaning bias output control in a second example of the second embodiment of the present invention.

FIG. 18 is a waveform chart illustrating a cleaning bias output control according to a second example of the second embodiment. In FIG. 18, the upper waveform corresponds to the current or voltage output to the repulsive roller 33. The lower waveform corresponds to the output control signal PWM T2(+) of the opposite polarity to the transfer polarity.

The second upper waveform corresponds to the output control signal PWM T2(−)B of the same polarity as the transfer polarity. The second lower waveform corresponds to the output control signal PWM T2(−)A of the same polarity as the transfer polarity. The second example of the second embodiment employs the power supply configuration illustrated in FIG. 16.

The second example of the second embodiment is different from the first example of the second embodiment in that each of the target output value and the actual output based thereon is in multiple stages in both the same polarity as the transfer polarity and the opposite polarity to the transfer polarity, and that the two output control signals PWM T2(−)B and PWM T2(−)A are used in the same polarity as the transfer polarity.

With the use of the two output control signals PWM T2(−)B and PWM T2(−)A in the same polarity as the transfer polarity, the cleaning bias starts to rise with a larger target output value than in the first example, thereby attaining a faster rise than in the first example, similarly to the example illustrated in FIG. 14.

As described above, although the signal line for the output control signal PWM T2(−)B and the signal line for the output control signal PWM T2(−)A are different in the configuration of FIG. 16, it is sufficient if the output control signals PWM T2(−)B and PWM T2(−)A output by the I/O control unit 70 are different. Thus, the same signal line may be used to transmit the output control signals PWM T2(−)B and PWM T2(−)A.

Further, in the second example of the second embodiment, the cleaning bias is output with the target output value set in two stages in the opposite polarity to the transfer polarity such that the target output value is larger in the first stage than in the second stage. With this configuration, the actual output slightly drops after the rise, preventing the cleaning bias from having an excessively large value.

In the cleaning bias output control according to the second embodiment described in the above first and second examples, it is sufficient if the power supply is configured to output a large bias corresponding to a large target output value in one of the polarities, i.e., the same polarity as the transfer polarity. Such a configuration minimizes the increase in cost of the power supply. Further, the configuration allows the quick rise of the DC component, thereby providing the effect of improving the cleaning performance of the bias cleaning. The quick rise of the DC component of the same polarity as the transfer polarity also improves the transfer performance of the image transfer in the tip portion of the recording sheet P (i.e., the tip portion of the image).

Further, the supply time of the DC component of the opposite polarity to the transfer polarity is increased in the bias cleaning. It is therefore possible to ensure a sufficient time for supplying the voltage necessary for the bias cleaning while suppressing the increase in overall supply time of the cleaning bias, thereby allowing reliable bias cleaning. In the second embodiment, the supply time of the DC component of the opposite polarity to the transfer polarity is thus increased in the bias cleaning, which is performed less frequently than the image transfer. Therefore, the increase in supply time of the DC component of the opposite polarity to the transfer polarity does not affect image transfer productivity much, similarly as in the first embodiment.

As described above, the second embodiment improves the cleaning performance of the bias cleaning while maximizing the cost efficiency of the power supply by minimizing the increase in cost of the power supply, and minimizes the reduction in productivity of the image transfer.

The electrical resistance of the members forming the transfer nip, such as the repulsive roller 33 or the secondary transfer roller 36 in the printer 1000 in FIG. 1, changes depending on, for example, the use environment of the member. Thus, the time taken for the rise of the DC component of the cleaning bias also changes depending on the use environment of the member. Therefore, optionally the image forming apparatus may include a temperature detector or a temperature and humidity detector for detecting the state of the environment to control (i.e., change) the rise time of the DC component based on the result of detection by the detector.

For example, in the printer 1000 in FIG. 1, a temperature and humidity sensor 110 serving as an environmental condition detector is provided at a position between the sheet feeding unit 105 and the secondary transfer nip N. The output from the temperature and humidity sensor 110 is input to the control unit 60. It is possible to improve the image quality by controlling the rise time of the DC component based on the detection result obtained from the temperature and humidity sensor 110.

In a low-temperature environment, the electrical resistance of the member forming the transfer nip such as the transfer roller is increased. In a low-humidity environment, the electrical resistance of the recording sheet is increased owing to a reduction in moisture amount of the recording sheet. In these environments, therefore, the value of the bias required for the bias cleaning is also increased, and the cleaning bias does not rise to the required voltage level unless the rise time is increased.

In a high-temperature environment, the electrical resistance of the member forming the transfer nip such as the transfer roller is reduced. In a high-humidity environment, the electrical resistance of the recording sheet is reduced owing to an increase in moisture amount of the recording sheet. In these environments, therefore, the value of the bias required for the bias cleaning is also reduced, and an excessively high voltage is supplied unless the rise time is reduced.

TABLE 2 given below illustrates an example of the control of the DC component rise time. The rise time of the DC component illustrated in the table corresponds to the time of the first stage when the cleaning bias is output with the target output value set in multiple stages in the same polarity as the transfer polarity. That is, the rise time of the DC component illustrated herein corresponds to the portion described as "FIRST STAGE" in FIGS. 13, 14, and 18.

TABLE 2

| | temperature, humidity | | |
|---|---|---|---|
| | 10° C., 15% | 23° C., 50% | 27° C., 80% |
| rise time | 50 msec. | 24 msec. | 10 msec. |

As illustrated in TABLE 2, the rise time is 24 msec. in a normal-temperature, normal-humidity environment (e.g., a temperature of 23° C. and a humidity of 50%), 50 msec. in a low-temperature, low-humidity environment (e.g., a temperature of 10° C. and a humidity of 15%), and 10 msec. in a high-temperature, high-humidity environment (e.g., a temperature of 27° C. and a humidity of 80%). The temperature and humidity groups and the rise times set as described above are illustrative, and may be set to other appropriate values in accordance with the configuration of the image forming apparatus.

Further, the image forming apparatus may include an electrical resistance detector that detects the electrical resistance of the member forming the transfer nip, such as the repulsive roller 33 or the secondary transfer roller 36 in the printer 1000 in FIG. 1, to control (i.e., change) the rise time of the DC component based on the result of detection by the electrical resistance detector. Similarly to the above-described control based on the environment conditions, the rise time to be controlled herein is the time of the first stage when the cleaning bias is output with the target output value set in multiple stages in the same polarity as the transfer polarity. That is, the rise time of the DC component illustrated herein corresponds to the portion described as "FIRST STAGE" in FIGS. 13, 14, and 18.

For example, the printer 1000 in FIG. 1 includes an electrical resistance detector 120 that detects the electrical resistance of the repulsive roller 33. The output from the electrical resistance detector 120 is input to the control unit 60. Specifically, the electrical resistance detector 120 is an ammeter or a voltmeter. The electrical resistance detector 120 may be disposed inside the power supply 39.

If the electrical resistance detected by the electrical resistance detector 120 is high, the bias required for the bias cleaning is also high. Therefore, the cleaning bias does not rise to the required voltage level unless the rise time is increased. If the electrical resistance detected by the electrical resistance detector 120 is low, the bias required for the bias cleaning is also low. Therefore, an excessively high voltage is supplied unless the rise time is reduced.

Similarly to the control based on the result of detection by the temperature and humidity sensor 110 serving as the environmental condition detector, the control based on the result of detection by the electrical resistance detector 120 may be performed with the result of detection by the electrical resistance detector 120 classified into three groups, i.e., a low resistance group, an intermediate resistance group, and a high resistance group, assigned with respective rise times. The electrical resistance detector 120 may have a commonly used configuration for detecting the electrical resistance. Further, the groups of electrical resistance values and the rise times may be appropriately set in accordance with the configuration of the image forming apparatus. Further, the control based on the environmental conditions and the control based on the electrical resistance may be performed in combination.

According to the embodiments of the present invention, the bias cleaning of the transfer member is controlled such that the DC component of the same polarity as the transfer polarity and the DC component of the opposite polarity to the transfer polarity are alternately supplied to the transfer member, and that the supply time of the DC component of the opposite polarity to the transfer polarity is longer than the supply time of the DC component of the same polarity as the transfer polarity in the alternating supply of the DC components. It is therefore to be noted that, when the above-described rise time corresponding to the first stage is controlled based on the environmental conditions, the electrical resistance value of the member forming the transfer nip, or the combination of the environmental conditions and the electrical resistance value of the member forming the transfer nip, the time for outputting the first stage portion of the cleaning bias is adjusted within a range satisfying the condition that the supply time of the DC component of the opposite polarity to the transfer polarity is longer than the supply time of the DC component of the same polarity as the transfer polarity in the alternating supply of the DC components.

As described above, the image forming apparatus according to an embodiment of the present invention reliably cleans the transfer member and prevents the contamination of the rear surface of the recording sheet, while obtaining a sufficient image density in both the recesses and projections on the front surface of the recording sheet.

Further, the image forming apparatus according to an embodiment of the present invention improves the cleaning performance of the bias cleaning while maximizing the cost efficiency of the power supply by minimizing the increase in cost of the power supply, and minimizes the reduction in productivity of the image transfer.

In the image forming apparatus according to an embodiment of the present invention configured to output the DC component of the same polarity as the transfer polarity with the target output value set in two stages, and output the DC component of the opposite polarity to the transfer polarity with the target output value set in one stage, a large bias is output at the rise of the DC component of the same polarity as the transfer polarity, thereby attaining a quick rise of the DC component. Therefore, the thus-configured image forming apparatus obtains improved cleaning performance of the bias cleaning and improved transfer performance of the image transfer in the tip portion of the recording sheet, and minimizes the reduction in productivity of the image transfer.

In the image forming apparatus according to an embodiment of the present invention configured to have the output (i.e., the target output value) of the DC component of the same polarity as the transfer polarity larger than the output (i.e., the target output value) of the DC component of the opposite polarity to the transfer polarity, a large bias is output. Therefore, the thus-configured image forming apparatus obtains both improved transfer performance of the image transfer and improved cleaning performance of the bias cleaning, and minimizes the reduction in productivity of the image transfer.

The image forming apparatus according to an embodiment of the present invention illustrated in the drawings employs an intermediate transfer system in which a toner image formed on a photoconductor serving as an image carrier is transferred onto a recording medium via an intermediate transfer member. However, the present invention is not limited thereto, and is also applicable to an image forming apparatus employing a direct transfer system.

Although illustration is omitted, in a typical configuration of the image forming apparatus employing the direct transfer system, a toner image formed on a photoconductor serving as an image carrier is directly transferred onto a recording sheet serving as a recording medium by transfer members, such as a transfer roller and a transfer and transport belt, disposed facing the photoconductor, and then the recording sheet is transported to a downstream fixing device by the transfer members such as the transfer roller and the transfer and transport belt. When the present invention is applied to such a configuration, the cleaning bias may be supplied to a transfer member to transfer toner and so forth on the transfer member to the photoconductor to allow a cleaning device provided to the photoconductor to clean the transferred toner and so forth. In this case, the polarity of the cleaning bias to be supplied to the transfer member may be set in accordance with the toner charging polarity set in the image forming apparatus employing the direct transfer system.

Further, the members forming the transfer nip may employ an appropriate configuration different from the above-described configuration. For example, the member facing the transfer roller may be configured as a belt. Further, the power supply capable of outputting a superimposed bias may employ an appropriate well-known configuration different from the above-described configuration.

Further, the respective units of the image forming apparatus may be configured as desired. For example, the arrangement order of the image forming units for the respective colors in the tandem image forming apparatus is arbitrary. Further, the present invention is not limited to the four-color image forming apparatus, and is also applicable to a full-color image forming apparatus using toners of three colors or a multicolor image forming apparatus using toners of two colors. The image forming apparatus is, of course, not limited to the printer, and may be a copier, a facsimile machine, or a multifunction machine having multiple functions.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described stages are not limited to the order disclosed herein. It is therefore to be understood that, within the scope of the appended claims, the disclosure of the present invention may be practiced otherwise than as specifically described herein.

What is claimed is:

1. An image forming apparatus comprising:

an image carrier to carry a toner image;

a transfer member to form a transfer nip between the image carrier and the transfer member;

a power supply to output a superimposed bias having a direct-current component superimposed with an alternating-current component and a direct-current bias including a direct-current component; and a control device that controls the power supply to output the superimposed bias or the direct-current bias including a transfer polarity to transfer the toner image on the image carrier onto a recording medium in the transfer nip, wherein the control device controls the power supply to alternately output a first bias corresponding to a direct-current component including the same polarity as the transfer polarity and a second bias corresponding to a direct-current component including a polarity opposite to the transfer polarity to clean the transfer member when image formation is not taking place, wherein the first bias is output with a target output value set in two stages including a first preceding stage and a second following stage including an absolute value lower than an absolute value of the first stage, and wherein an output time of the second bias is longer than an output time of the first bias.

2. The image forming apparatus according to claim 1, wherein the second bias is output with a target output value set in one stage.

3. The image forming apparatus according to claim 1, wherein, when image formation is performed on one or more recording media, cleaning of the transfer member takes place after the start of image formation and before entry of a first recording medium into the transfer nip.

4. The image forming apparatus according to claim 1, wherein, when image formation is performed on one or more recording media, cleaning of the transfer member takes place before the completion of image formation and after passage of a last recording medium through the transfer nip.

5. The image forming apparatus according to claim 1, wherein cleaning of the transfer member takes place during a time in which image formation is not taking place.

6. The image forming apparatus according to claim 5, wherein the time in which image formation is not taking place is one of a time in which a recovery operation from a jam takes place and a time in which a recovery operation from abnormal termination of the image forming apparatus takes place.

7. The image forming apparatus according to claim 1, wherein, when image formation is performed on a plurality of recording media, cleaning of the transfer member takes place after the start of image formation and between successive recording media.

8. The image forming apparatus according to claim 1, wherein alternating output of the first bias and the second bias is performed a plurality of times during cleaning of the transfer member.

9. The image forming apparatus according to claim 1, wherein the target output value of the first stage includes a first target output value for a first period and a second target output value for a second period following the first period different from the first target output value.

10. The image forming apparatus according to claim 9, wherein the first target output value is larger than the second target output value.

11. The image forming apparatus according to claim 9, wherein cleaning of the transfer member is performed with a control signal for outputting the first target output value during the first period and a control signal for outputting the second target output value during the second period.

12. The image forming apparatus according to claim 1, further comprising an environmental condition detector to detect an environmental condition, wherein the control device controls a time in which the power supply outputs the first bias with the target output value of the first stage based on environmental conditions detected by the environmental condition detector.

13. The image forming apparatus according to claim 1, further comprising an electrical resistance detector to detect the electrical resistance of the transfer member or another member forming the transfer nip, wherein the control device controls a time in which the power supply outputs the first bias with the target output value of the first stage based on resistances detected by the electrical resistance detector.

14. An image forming apparatus comprising:

an image carrier to carry a toner image;

a transfer member to form a transfer nip between the image carrier and the transfer member;

a power supply to output a superimposed bias having a direct-current component superimposed with an alternating-current component and a direct-current bias including a direct-current component; and a control device that controls the power supply to output the superimposed bias or the direct-current bias including a transfer polarity to transfer the toner image on the image carrier onto a recording medium in the transfer nip, wherein the control device controls the power supply to alternately output a first bias corresponding to a direct-current component including the same polarity as the transfer polarity and a second bias corresponding to a direct-current component including a polarity opposite to the transfer polarity to clean the transfer member when image formation is not taking place, wherein an absolute value of an output of the first bias decreases after the absolute value of the output increases, and wherein an output time of the second bias is longer than an output time of the first bias.

* * * * *